US007136599B2

(12) United States Patent
Matsuura et al.

(10) Patent No.: US 7,136,599 B2
(45) Date of Patent: Nov. 14, 2006

(54) DEVELOPING APPARATUS, IMAGE FORMING APPARATUS, AND DEVELOPING METHOD

(75) Inventors: Masahiko Matsuura, Suita (JP); Kentaro Katori, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 211 days.

(21) Appl. No.: 10/981,646

(22) Filed: Nov. 5, 2004

(65) Prior Publication Data

US 2005/0196189 A1 Sep. 8, 2005

(30) Foreign Application Priority Data

Mar. 4, 2004 (JP) ..... 2004-060715

(51) Int. Cl.
*G03G 15/06* (2006.01)

(52) U.S. Cl. ..... 399/55; 399/285

(58) Field of Classification Search ..... 399/44, 399/55, 284, 285; 430/103, 120
See application file for complete search history.

(56) References Cited

U.S. PATENT DOCUMENTS 5,044,310 A 9/1991 Kanbe et al.
5,428,428 A 6/1995 Haneda
5,548,381 A * 8/1996 Saito et al. ..... 399/55
6,167,212 A * 12/2000 Satoh et al. ..... 399/55
6,272,306 B1 * 8/2001 Saito et al. ..... 399/270
6,301,453 B1 * 10/2001 Tsutsumi ..... 399/55
6,459,862 B1 * 10/2002 Sakemi et al. ..... 399/55
6,526,238 B1 * 2/2003 Kin et al. ..... 399/55
6,829,447 B1 * 12/2004 Okano ..... 399/55

FOREIGN PATENT DOCUMENTS

JP 07-333957 12/1995
JP 2003-029507 1/2003

* cited by examiner

*Primary Examiner*—Robert Beatty
(74) *Attorney, Agent, or Firm*—Morrison & Foerster LLP

(57) ABSTRACT

It is intended to provide a developing apparatus, an image forming apparatus and developing method capable of managing both decrease of load on apparatuses and improvement of image quality in case development of an image is made by applying contact developing and AC developing. For that intention, voltage at a portion between a development member and an image carrier is defined oscillating voltage, and in case negative polarity toner is used, relations of peak voltage V1 of oscillating voltage, background portion voltage VH (negative) and visible section voltage VL (negative, an absolute value of it is smaller than that of VH) are set as indicated below.

$$-500V \leqq V1-VL \leqq -350V$$

$$-200V \leqq V1-VH \leqq -50V$$

On the above conditions, peak voltage V2 is set as indicated below.

$$-150V \leqq VL-V2 \leqq -70V$$

$$V2 \leqq VH+500V.$$

20 Claims, 23 Drawing Sheets

FIG.3

TD (TRANSMITTANCE FACTOR DENSITY)

| | |
|---|---|
| ~1.25 | × |
| 1.26~1.31 | △ |
| 1.32~1.42 | ○ |
| 1.43~1.49 | △ |
| 1.50~ | × |

FIG.4

EVENNESS (SOLID/DOT)

| | |
|---|---|
| VERY GOOD | ◎ |
| GOOD | ○ |
| ACCEPTABLE | △ |
| BAD | × |
| VERY BAD | × × |

FIG.5

FOG

| | |
|---|---|
| $C \leqq C^* \leqq 1$, NO TONER ADHESION | ◎ |
| $1 \leqq C^* \leqq 3$, A BIT OF TONER ADHESION BUT NO PROBLEM | ○ |
| $3 < C^* \leqq 5$, SOME TONER ADHESION BUT NO PROBLEM FOR PRACTICAL USE | △ |
| $5 < C^* \leqq 8$, CONSIDARABLE TONER ADHESION AND BIT OF TROUBLESOME FOR PRACTICAL USE | × |
| $C^* > 8$, TROBLESOME FOR PRACTICAL USE | × × |

FIG.6

REPRODUCIBILITY OF HIGHLIGHT SEC.
REPRODUCIBILITY OF 1 TO 2 STAGES
OUT OF 32-GRADATION PATTERNS

| | |
|---|---|
| REPRODUCED WELL | ○ |
| ACCEPTABLE | △ |
| NOT REPRODUCED | × |

FIG.7

COMPREHENSIVE EVALUATION

| | |
|---|---|
| 全て○～ | ◎ |
| △1 | ○ |
| △2 | △ |
| △3～ | × |
| ×1～ | × |

FIG.8

| Vpp | V2 | V1 | Duty | V1-VL | VL-V2 | VH-V2 | V1-VH | TD | DENSITY | EVENNESS (SOLID) | EVENNESS (DOT) | FOG | REPRODUCIBILITY OF HIGHLIGHT SEC. | COMPREHENSIVE EVALUATION |
|---|---|---|---|---|---|---|---|---|---|---|---|---|---|---|
| 400 | 100 | -300 | 40 | -250 | -150 | -400 | 0 | 1.21 | × | ○ | × | ○ | × | × |
| 400 | 60 | -340 | 40 | -290 | -110 | -360 | -40 | 1.29 | △ | ◎ | × | ○ | △ | × |
| 400 | 40 | -360 | 40 | -310 | -90 | -340 | -60 | 1.34 | ○ | ◎ | × | ◎ | ○ | × |
| 400 | 20 | -380 | 40 | -330 | -70 | -320 | -80 | 1.38 | ○ | ◎ | △ | ◎ | ○ | ○ |
| 400 | 0 | -400 | 40 | -350 | -50 | -300 | -100 | 1.42 | ○ | △ | ○ | ◎ | ○ | ○ |
| 400 | -20 | -420 | 40 | -370 | -30 | -280 | -120 | 1.45 | △ | × | ○ | ◎ | ○ | × |
| 400 | -60 | -460 | 40 | -410 | 10 | -240 | -160 | 1.55 | × | × | ○ | ◎ | ○ | × |

FIG.9

| Vpp | V2 | V1 | Duty | V1-VL | VL-V2 | VH-V2 | V1-VH | TD | DENSITY | EVENNESS (SOLID) | EVENNESS (DOT) | FOG | REPRODUCIBILITY OF HIGHLIGHT SEC. | COMPREHENSIVE EVALUATION |
|---|---|---|---|---|---|---|---|---|---|---|---|---|---|---|
| 450 | 125 | -325 | 25 | -275 | -175 | -425 | -25 | 1.13 | × | △ | × | ○ | × | × |
| 450 | 65 | -385 | 25 | -335 | -115 | -365 | -85 | 1.17 | × | ○ | △ | ○ | △ | × |
| 450 | 25 | -425 | 25 | -375 | -75 | -325 | -125 | 1.26 | △ | ◎ | ○ | ◎ | ○ | ○ |
| 450 | 5 | -445 | 25 | -395 | -55 | -305 | -145 | 1.31 | △ | △ | ○ | ◎ | ○ | △ |
| 450 | -15 | -465 | 25 | -415 | -35 | -285 | -165 | 1.35 | ○ | × | ○ | ◎ | ○ | × |
| 450 | -75 | -525 | 25 | -475 | 25 | -225 | -225 | 1.43 | △ | × | ○ | △ | ○ | × |
| 450 | 65 | -385 | 30 | -335 | -115 | -365 | -85 | 1.23 | × | ○ | △ | ◎ | × | × |
| 450 | 45 | -405 | 30 | -355 | -95 | -345 | -105 | 1.28 | △ | ○ | ○ | ◎ | ○ | ○ |
| 450 | 25 | -425 | 30 | -375 | -75 | -325 | -125 | 1.32 | ○ | ◎ | ◎ | ◎ | ○ | ◎ |
| 450 | 5 | -445 | 30 | -395 | -55 | -305 | -145 | 1.36 | ○ | △ | ○ | ◎ | ○ | ○ |
| 450 | -15 | -465 | 30 | -415 | -35 | -285 | -165 | 1.37 | ○ | × | ○ | ◎ | ○ | × |
| 450 | -35 | -485 | 30 | -435 | -15 | -265 | -185 | 1.41 | ○ | × | ○ | ◎ | ○ | × |
| 450 | 125 | -325 | 40 | -275 | -175 | -425 | -25 | 1.18 | × | △ | × | ○ | × | × |
| 450 | 85 | -365 | 40 | -315 | -135 | -385 | -65 | 1.28 | △ | ○ | △ | ○ | ○ | △ |
| 450 | 45 | -405 | 40 | -355 | -95 | -345 | -105 | 1.37 | ○ | ◎ | ○ | ○ | ○ | ◎ |
| 450 | 25 | -425 | 40 | -375 | -75 | -325 | -125 | 1.41 | ○ | ◎ | ○ | ◎ | ○ | ◎ |
| 450 | 5 | -445 | 40 | -395 | -55 | -305 | -145 | 1.44 | △ | △ | ○ | ◎ | ○ | △ |
| 450 | -35 | -485 | 40 | -435 | -15 | -265 | -185 | 1.52 | × | × | ○ | ◎ | ○ | × |
| 450 | 125 | -325 | 50 | -275 | -175 | -425 | -25 | 1.29 | △ | △ | × | ○ | × | × |
| 450 | 85 | -365 | 50 | -315 | -135 | -385 | -65 | 1.38 | ○ | ○ | × | ○ | ○ | × |
| 450 | 65 | -385 | 50 | -335 | -115 | -365 | -85 | 1.42 | ○ | ◎ | △ | ○ | ○ | ○ |
| 450 | 45 | -405 | 50 | -355 | -95 | -345 | -105 | 1.45 | △ | ◎ | ○ | ○ | ○ | ○ |
| 450 | 25 | -425 | 50 | -375 | -75 | -325 | -125 | 1.49 | △ | ○ | ◎ | ◎ | ○ | ○ |

FIG.10

| Vpp | V2 | V1 | Duty | V1-VL | VL-V2 | VH-V2 | V1-VH | TD | DENSITY | EVENNESS (SOLID) | EVENNESS (DOT) | FOG | REPRODUCIBILITY OF HIGHLIGHT SEC. | COMPREHENSIVE EVALUATION |
|---|---|---|---|---|---|---|---|---|---|---|---|---|---|---|
| 600 | 140 | -460 | 25 | -410 | -190 | -440 | -160 | 1.05 | × | × | × | ○ | × | × |
| 600 | 120 | -480 | 25 | -430 | -170 | -420 | -180 | 1.13 | × | △ | △ | ○ | × | × |
| 600 | 100 | -500 | 25 | -450 | -150 | -400 | -200 | 1.18 | × | ○ | △ | ○ | × | × |
| 600 | 80 | -520 | 25 | -470 | -130 | -380 | -220 | 1.23 | × | ◎ | ○ | △ | △ | × |
| 600 | 40 | -560 | 25 | -510 | -90 | -340 | -260 | 1.32 | ○ | ○ | ○ | × | ○ | × |
| 600 | 0 | -600 | 25 | -550 | -50 | -300 | -300 | DISCHARGE | | | | | | |
| 600 | 140 | -460 | 30 | -410 | -190 | -440 | -160 | 1.15 | × | × | × | ○ | × | × |
| 600 | 120 | -480 | 30 | -430 | -170 | -420 | -180 | 1.21 | × | △ | △ | ○ | × | × |
| 600 | 100 | -500 | 30 | -450 | -150 | -400 | -200 | 1.25 | △ | ○ | ○ | ○ | △ | △ |
| 600 | 60 | -540 | 30 | -490 | -110 | -360 | -240 | 1.34 | ○ | ◎ | ○ | △ | ○ | ○ |
| 600 | 40 | -560 | 30 | -510 | -90 | -340 | -260 | 1.38 | ○ | ○ | ○ | × | ○ | × |
| 600 | 0 | -600 | 30 | -550 | -50 | -300 | -300 | DISCHARGE | | | | | | |
| 600 | 140 | -460 | 40 | -410 | -190 | -440 | -160 | 1.29 | △ | × | × | ○ | ○ | × |
| 600 | 120 | -480 | 40 | -430 | -170 | -420 | -180 | 1.34 | ○ | △ | △ | ○ | ○ | △ |
| 600 | 100 | -500 | 40 | -450 | -150 | -400 | -200 | 1.38 | ○ | ○ | ◎ | ○ | ○ | ◎ |
| 600 | 80 | -520 | 40 | -470 | -130 | -380 | -220 | 1.42 | ○ | ◎ | ○ | △ | ○ | ○ |
| 600 | 60 | -540 | 40 | -490 | -110 | -360 | -240 | 1.45 | △ | ◎ | ○ | × | ○ | × |
| 600 | 40 | -560 | 40 | -510 | -90 | -340 | -260 | 1.49 | △ | ○ | ○ | × | ○ | × |
| 600 | 0 | -600 | 40 | -550 | -50 | -300 | -300 | DISCHARGE | | | | | | |
| 600 | 200 | -400 | 50 | -350 | -250 | -500 | -100 | 1.29 | △ | × | × | △ | ○ | × |
| 600 | 180 | -420 | 50 | -370 | -230 | -480 | -120 | 1.34 | ○ | × | × | ○ | ○ | × |
| 600 | 160 | -440 | 50 | -390 | -210 | -460 | -140 | 1.38 | ○ | × | × | ○ | ○ | × |
| 600 | 140 | -460 | 50 | -410 | -190 | -440 | -160 | 1.42 | ○ | × | × | ○ | ○ | × |
| 600 | 120 | -480 | 50 | -430 | -170 | -420 | -180 | 1.45 | △ | △ | △ | ○ | ○ | △ |

FIG.11

| Vpp | V2 | V1 | Duty | V1-VL | VL-V2 | VH-V2 | V1-VH | TD | DENSITY | EVENNESS (SOLID) | EVENNESS (DOT) | FOG | REPRODUCIBILITY OF HIGHLIGHT SEC | COMPREHENSIVE EVALUATION |
|---|---|---|---|---|---|---|---|---|---|---|---|---|---|---|
| 650 | 165 | -485 | 40 | -435 | -215 | -465 | -185 | 1.28 | △ | × | × | ○ | ○ | × |
| 650 | 145 | -505 | 40 | -455 | -195 | -445 | -205 | 1.33 | ○ | × | × | △ | ○ | × |
| 650 | 125 | -525 | 40 | -475 | -175 | -425 | -225 | 1.37 | ○ | △ | △ | △ | ○ | × |
| 650 | 105 | -545 | 40 | -495 | -155 | -405 | -245 | 1.41 | ○ | △ | ○ | × | ○ | × |
| 650 | 85 | -565 | 40 | -515 | -135 | -385 | -265 | 1.44 | △ | ○ | ○ | × | ○ | × |
| 650 | 65 | -585 | 40 | -535 | -115 | -365 | -285 | DISCHARGE | | | | | | |
| 650 | 25 | -625 | 40 | -575 | -75 | -325 | -325 | DISCHARGE | | | | | | |

FIG.12

| Vpp | V2 | V1 | Duty | V1-VL | VL-V2 | VH-V2 | V1-VH | TD | DENSITY | EVENNESS (SOLID) | EVENNESS (DOT) | FOG | REPRODUCIBILITY OF HIGHLIGHT SEC. | COMPREHENSIVE EVALUATION |
|---|---|---|---|---|---|---|---|---|---|---|---|---|---|---|
| 700 | 240 | -460 | 45 | -410 | -290 | -540 | -160 | 1.26 | △ | × | × | ×× | ○ | × |
| 700 | 220 | -480 | 45 | -430 | -270 | -520 | -180 | 1.29 | ○ | × | × | △ | ○ | × |
| 700 | 200 | -500 | 45 | -450 | -250 | -500 | -200 | 1.33 | ○ | × | × | ○ | ○ | × |
| 700 | 180 | -520 | 45 | -470 | -230 | -480 | -220 | 1.37 | ○ | × | × | △ | ○ | × |
| 700 | 160 | -540 | 45 | -490 | -210 | -460 | -240 | 1.39 | ○ | × | × | × | ○ | × |
| 700 | 140 | -560 | 45 | -510 | -190 | -440 | -260 | 1.43 | △ | × | × | × | ○ | × |

FIG.13

| Vpp | V2 | V1 | Duty | V1-VL | VL-V2 | VH-V2 | V1-VH | TD | DENSITY | EVENNESS (SOLID) | EVENNESS (DOT) | FOG | REPRODUCIBILITY OF HIGHLIGHT SEC. | COMPREHENSIVE EVALUATION |
|---|---|---|---|---|---|---|---|---|---|---|---|---|---|---|
| 400 | 100 | -300 | 40 | -250 | -150 | -500 | 100 | 1.21 | × | ○ | × | ○ | × | × |
| 400 | 60 | -340 | 40 | -290 | -110 | -460 | 60 | 1.29 | △ | ◎ | × | ○ | × | × |
| 400 | 40 | -360 | 40 | -310 | -90 | -440 | 40 | 1.34 | ○ | ◎ | × | ◎ | × | × |
| 400 | 20 | -380 | 40 | -330 | -70 | -420 | 20 | 1.38 | ○ | ◎ | △ | ◎ | × | × |
| 400 | 0 | -400 | 40 | -350 | -50 | -400 | 0 | 1.42 | ○ | △ | ○ | ◎ | × | × |
| 400 | -20 | -420 | 40 | -370 | -30 | -380 | -20 | 1.45 | △ | × | ○ | ◎ | × | × |
| 400 | -60 | -460 | 40 | -410 | 10 | -340 | -60 | 1.55 | × | × | ○ | ◎ | ○ | × |

FIG.14

| Vpp | V2 | V1 | Duty | V1-VL | VL-V2 | VH-V2 | V1-VH | TD | DENSITY | EVENNESS (SOLID) | EVENNESS (DOT) | FOG | REPRODUCIBILITY OF HIGHLIGHT SEC. | COMPREHENSIVE EVALUATION |
|---|---|---|---|---|---|---|---|---|---|---|---|---|---|---|
| 450 | 125 | -325 | 25 | -275 | -175 | -525 | 75 | 1.13 | × | △ | × | × | × | × |
| 450 | 65 | -385 | 25 | -335 | -115 | -465 | 15 | 1.17 | × | ○ | △ | ○ | × | × |
| 450 | 25 | -425 | 25 | -375 | -75 | -425 | -25 | 1.26 | △ | ◎ | ○ | ◎ | × | × |
| 450 | 5 | -445 | 25 | -395 | -55 | -405 | -45 | 1.31 | △ | △ | ○ | ◎ | △ | × |
| 450 | -15 | -465 | 25 | -415 | -35 | -385 | -65 | 1.35 | ○ | × | ○ | ◎ | ○ | × |
| 450 | -75 | -525 | 25 | -475 | 25 | -325 | -125 | 1.43 | △ | × | ○ | ◎ | ○ | × |
| 450 | 65 | -385 | 30 | -335 | -115 | -465 | 15 | 1.23 | × | ○ | △ | ◎ | × | × |
| 450 | 45 | -405 | 30 | -355 | -95 | -445 | -5 | 1.28 | △ | ○ | ○ | ◎ | × | × |
| 450 | 25 | -425 | 30 | -375 | -75 | -425 | -25 | 1.32 | ○ | ◎ | ◎ | ◎ | × | × |
| 450 | 5 | -445 | 30 | -395 | -55 | -405 | -45 | 1.36 | ○ | △ | ○ | ◎ | △ | △ |
| 450 | -15 | -465 | 30 | -415 | -35 | -385 | -65 | 1.37 | ○ | × | ○ | ◎ | ○ | × |
| 450 | -35 | -485 | 30 | -435 | -15 | -365 | -85 | 1.41 | ○ | × | ○ | ◎ | ○ | × |
| 450 | 125 | -325 | 40 | -275 | -175 | -525 | 75 | 1.18 | × | △ | × | ○ | × | × |
| 450 | 85 | -365 | 40 | -315 | -135 | -485 | 35 | 1.28 | △ | ○ | △ | ○ | × | × |
| 450 | 45 | -405 | 40 | -355 | -95 | -445 | -5 | 1.37 | ○ | ◎ | ○ | ○ | × | × |
| 450 | 25 | -425 | 40 | -375 | -75 | -425 | -25 | 1.41 | ○ | ◎ | ○ | ◎ | × | × |
| 450 | 5 | -445 | 40 | -395 | -55 | -405 | -45 | 1.44 | △ | △ | ○ | ◎ | △ | × |
| 450 | -35 | -485 | 40 | -435 | -15 | -365 | -85 | 1.52 | × | × | ○ | ◎ | ○ | × |
| 450 | 125 | -325 | 50 | -275 | -175 | -525 | 75 | 1.29 | △ | △ | × | ○ | × | × |
| 450 | 85 | -365 | 50 | -315 | -135 | -485 | 35 | 1.38 | ○ | ○ | × | ○ | × | × |
| 450 | 65 | -385 | 50 | -335 | -115 | -465 | 15 | 1.42 | ○ | ○ | △ | ○ | × | × |
| 450 | 45 | -405 | 50 | -355 | -95 | -445 | -5 | 1.45 | △ | ◎ | ○ | ○ | × | × |
| 450 | 25 | -425 | 50 | -375 | -75 | -425 | -25 | 1.49 | △ | ○ | ◎ | ◎ | × | × |

FIG.15

| Vpp | V2 | V1 | Duty | V1-VL | VL-V2 | VH-V2 | V1-VH | TD | DENSITY | EVENNESS (SOLID) | EVENNESS (DOT) | FOG | REPRODUCIBILITY OF HIGHLIGHT SEC. | COMPREHENSIVE EVALUATION |
|---|---|---|---|---|---|---|---|---|---|---|---|---|---|---|
| 600 | 140 | -460 | 25 | -410 | -190 | -540 | -60 | 1.05 | × | × | × | × | × | × |
| 600 | 120 | -480 | 25 | -430 | -170 | -520 | -80 | 1.13 | × | △ | △ | × | × | × |
| 600 | 100 | -500 | 25 | -450 | -150 | -500 | -100 | 1.18 | × | ○ | △ | ○ | × | × |
| 600 | 80 | -520 | 25 | -470 | -130 | -480 | -120 | 1.23 | × | ◎ | ○ | ○ | ○ | × |
| 600 | 40 | -560 | 25 | -510 | -90 | -440 | -160 | 1.32 | ○ | ○ | ○ | ○ | ○ | ◎ |
| 600 | 0 | -600 | 25 | -550 | -50 | -400 | -200 | DISCHARGE | | | | | | |
| 600 | 140 | -460 | 30 | -410 | -190 | -540 | -60 | 1.15 | × | × | × | × | × | × |
| 600 | 120 | -480 | 30 | -430 | -170 | -520 | -80 | 1.21 | × | △ | △ | △ | △ | × |
| 600 | 100 | -500 | 30 | -450 | -150 | -500 | -100 | 1.25 | △ | ○ | ○ | ○ | ○ | ○ |
| 600 | 60 | -540 | 30 | -490 | -110 | -460 | -140 | 1.34 | ○ | ◎ | ○ | ○ | ○ | ◎ |
| 600 | 40 | -560 | 30 | -510 | -90 | -440 | -160 | 1.38 | ○ | ○ | ○ | ○ | ○ | ◎ |
| 600 | 0 | -600 | 30 | -550 | -50 | -400 | -200 | DISCHARGE | | | | | | |
| 600 | 140 | -460 | 40 | -410 | -190 | -540 | -60 | 1.29 | △ | × | × | × | ○ | × |
| 600 | 120 | -480 | 40 | -430 | -170 | -520 | -80 | 1.34 | ○ | △ | △ | △ | ○ | × |
| 600 | 100 | -500 | 40 | -450 | -150 | -500 | -100 | 1.38 | ○ | ○ | ◎ | ○ | ○ | ○ |
| 600 | 80 | -520 | 40 | -470 | -130 | -480 | -120 | 1.42 | ○ | ◎ | ○ | ○ | ○ | ◎ |
| 600 | 60 | -540 | 40 | -490 | -110 | -460 | -140 | 1.45 | △ | ◎ | ○ | ○ | ○ | ○ |
| 600 | 40 | -560 | 40 | -510 | -90 | -440 | -160 | 1.49 | △ | ○ | ○ | ○ | ○ | ○ |
| 600 | 0 | -600 | 40 | -550 | -50 | -400 | -200 | DISCHARGE | | | | | | |
| 600 | 200 | -400 | 50 | -350 | -250 | -600 | 0 | 1.29 | △ | × | × | ×× | × | × |
| 600 | 180 | -420 | 50 | -370 | -230 | -580 | -20 | 1.34 | ○ | × | × | ×× | × | × |
| 600 | 160 | -440 | 50 | -390 | -210 | -560 | -40 | 1.38 | ○ | × | × | × | × | × |
| 600 | 140 | -460 | 50 | -410 | -190 | -540 | -60 | 1.42 | ○ | × | × | × | ○ | × |
| 600 | 120 | -480 | 50 | -430 | -170 | -520 | -80 | 1.45 | △ | △ | △ | × | ○ | × |

FIG.16

| Vpp | V2 | V1 | Duty | V1-VL | VL-V2 | VH-V2 | V1-VH | TD | DENSITY | EVENNESS (SOLID) | EVENNESS (DOT) | FOG | REPRODUCIBILITY OF HIGHLIGHT SEC. | COMPREHENSIVE EVALUATION |
|---|---|---|---|---|---|---|---|---|---|---|---|---|---|---|
| 650 | 165 | -485 | 40 | -435 | -215 | -565 | -85 | 1.28 | △ | × | × | × | ○ | × |
| 650 | 145 | -505 | 40 | -455 | -195 | -545 | -105 | 1.33 | ○ | × | × | × | ○ | × |
| 650 | 125 | -525 | 40 | -475 | -175 | -525 | -125 | 1.37 | ○ | △ | △ | × | ○ | × |
| 650 | 105 | -545 | 40 | -495 | -155 | -505 | -145 | 1.41 | ○ | △ | ○ | △ | ○ | △ |
| 650 | 85 | -565 | 40 | -515 | -135 | -485 | -165 | 1.44 | △ | ○ | ○ | ○ | ○ | ○ |
| 650 | 65 | -585 | 40 | -535 | -115 | -465 | -185 | DISCHARGE | | | | | | |
| 650 | 25 | -625 | 40 | -575 | -75 | -425 | -225 | DISCHARGE | | | | | | |

FIG.17

| Vpp | V2 | V1 | Duty | V1-VL | VL-V2 | VH-V2 | V1-VH | TD | DENSITY | EVENNESS (SOLID) | EVENNESS (DOT) | FOG | REPRODUCIBILITY OF HIGHLIGHT SEC. | COMPREHENSIVE EVALUATION |
|---|---|---|---|---|---|---|---|---|---|---|---|---|---|---|
| 700 | 240 | -460 | 45 | -410 | -290 | -640 | -60 | 1.26 | △ | × | × | ×× | ○ | × |
| 700 | 220 | -480 | 45 | -430 | -270 | -620 | -80 | 1.29 | ○ | × | × | ×× | ○ | × |
| 700 | 200 | -500 | 45 | -450 | -250 | -600 | -100 | 1.33 | ○ | × | × | ×× | ○ | × |
| 700 | 180 | -520 | 45 | -470 | -230 | -580 | -120 | 1.37 | ○ | × | × | ×× | ○ | × |
| 700 | 160 | -540 | 45 | -490 | -210 | -560 | -140 | 1.39 | ○ | × | × | × | ○ | × |
| 700 | 140 | -560 | 45 | -510 | -190 | -540 | -160 | 1.43 | △ | × | × | × | ○ | × |

FIG.18

| Vpp | V2 | V1 | Duty | V1-VL | VL-V2 | VH-V2 | V1-VH | TD | DENSITY | EVENNESS (SOLID) | EVENNESS (DOT) | FOG | REPRODUCIBILITY OF HIGHLIGHT SEC. | COMPREHENSIVE EVALUATION |
|---|---|---|---|---|---|---|---|---|---|---|---|---|---|---|
| 400 | 100 | -300 | 40 | -250 | -150 | -600 | 200 | 1.21 | × | ○ | × | ×× | × | × |
| 400 | 60 | -340 | 40 | -290 | -110 | -560 | 160 | 1.29 | △ | ◎ | × | ×× | × | × |
| 400 | 40 | -360 | 40 | -310 | -90 | -540 | 140 | 1.34 | ○ | ◎ | × | × | × | × |
| 400 | 20 | -380 | 40 | -330 | -70 | -520 | 120 | 1.38 | ○ | ◎ | △ | × | × | × |
| 400 | 0 | -400 | 40 | -350 | -50 | -500 | 100 | 1.42 | ○ | △ | ○ | ○ | × | × |
| 400 | -20 | -420 | 40 | -370 | -30 | -480 | 80 | 1.45 | △ | × | ○ | ○ | × | × |
| 400 | -60 | -460 | 40 | -410 | 10 | -440 | 40 | 1.55 | × | × | ○ | ○ | × | × |

FIG.19

| Vpp | V2 | V1 | Duty | V1-VL | VL-V2 | VH-V2 | V1-VH | TD | DENSITY | EVENNESS (SOLID) | EVENNESS (DOT) | FOG | REPRODUCIBILITY OF HIGHLIGHT SEC. | COMPREHENSIVE EVALUATION |
|---|---|---|---|---|---|---|---|---|---|---|---|---|---|---|
| 450 | 125 | -325 | 25 | -275 | -175 | -625 | 175 | 1.13 | × | △ | × | ×× | × | × |
| 450 | 65 | -385 | 25 | -335 | -115 | -565 | 115 | 1.17 | × | ○ | △ | ×× | × | × |
| 450 | 25 | -425 | 25 | -375 | -75 | -525 | 75 | 1.26 | △ | ◎ | ○ | × | × | × |
| 450 | 5 | -445 | 25 | -395 | -55 | -505 | 55 | 1.31 | △ | △ | ○ | △ | × | × |
| 450 | -15 | -465 | 25 | -415 | -35 | -485 | 35 | 1.35 | ○ | × | ○ | ○ | × | × |
| 450 | -75 | -525 | 25 | -475 | 25 | -425 | -25 | 1.43 | △ | × | ○ | ○ | × | × |
| 450 | 65 | -385 | 30 | -335 | -115 | -565 | 115 | 1.23 | × | ○ | △ | ×× | × | × |
| 450 | 45 | -405 | 30 | -355 | -95 | -545 | 95 | 1.28 | △ | ○ | ○ | × | × | × |
| 450 | 25 | -425 | 30 | -375 | -75 | -525 | 75 | 1.32 | ○ | ◎ | ◎ | × | × | × |
| 450 | 5 | -445 | 30 | -395 | -55 | -505 | 55 | 1.36 | ○ | △ | ○ | △ | × | × |
| 450 | -15 | -465 | 30 | -415 | -35 | -485 | 35 | 1.37 | ○ | × | ○ | ○ | × | × |
| 450 | -35 | -485 | 30 | -435 | -15 | -465 | 15 | 1.41 | ○ | × | ○ | ○ | × | × |
| 450 | 125 | -325 | 40 | -275 | -175 | -625 | 175 | 1.18 | × | △ | × | ×× | × | × |
| 450 | 85 | -365 | 40 | -315 | -135 | -585 | 135 | 1.28 | △ | ○ | △ | ×× | × | × |
| 450 | 45 | -405 | 40 | -355 | -95 | -545 | 95 | 1.37 | ○ | ◎ | ○ | × | × | × |
| 450 | 25 | -425 | 40 | -375 | -75 | -525 | 75 | 1.41 | ○ | ◎ | ○ | × | × | × |
| 450 | 5 | -445 | 40 | -395 | -55 | -505 | 55 | 1.44 | △ | △ | ○ | △ | × | × |
| 450 | -35 | -485 | 40 | -435 | -15 | -465 | 15 | 1.52 | × | × | ○ | ○ | × | × |
| 450 | 125 | -325 | 50 | -275 | -175 | -625 | 175 | 1.29 | △ | △ | × | ×× | × | × |
| 450 | 85 | -365 | 50 | -315 | -135 | -585 | 135 | 1.38 | ○ | ○ | × | ×× | × | × |
| 450 | 65 | -385 | 50 | -335 | -115 | -565 | 115 | 1.42 | ○ | ○ | △ | ×× | × | × |
| 450 | 45 | -405 | 50 | -355 | -95 | -545 | 95 | 1.45 | △ | ◎ | ○ | × | × | × |
| 450 | 25 | -425 | 50 | -375 | -75 | -525 | 75 | 1.49 | △ | ○ | ◎ | × | × | × |

FIG.20

| Vpp | V2 | V1 | Duty | V1-VL | VL-V2 | VH-V2 | V1-VH | TD | DENSITY | EVENNESS (SOLID) | EVENNESS (DOT) | FOG | REPRODUCIBILITY OF HIGHLIGHT SEC. | COMPREHENSIVE EVALUATION |
|---|---|---|---|---|---|---|---|---|---|---|---|---|---|---|
| 600 | 140 | -460 | 25 | -410 | -190 | -640 | 40 | 1.05 | × | × | × | ×× | × | × |
| 600 | 120 | -480 | 25 | -430 | -170 | -620 | 20 | 1.13 | × | △ | △ | ×× | × | × |
| 600 | 100 | -500 | 25 | -450 | -150 | -600 | 0 | 1.18 | × | ○ | △ | ×× | × | × |
| 600 | 80 | -520 | 25 | -470 | -130 | -580 | -20 | 1.23 | × | ◎ | ○ | × | × | × |
| 600 | 40 | -560 | 25 | -510 | -90 | -540 | -60 | 1.32 | ○ | ○ | ○ | × | ○ | × |
| 600 | 0 | -600 | 25 | -550 | -50 | -500 | -100 | DISCHARGE | | | | | | |
| 600 | 140 | -460 | 30 | -410 | -190 | -640 | 40 | 1.15 | × | × | × | ×× | × | × |
| 600 | 120 | -480 | 30 | -430 | -170 | -620 | 20 | 1.21 | × | △ | △ | ×× | × | × |
| 600 | 100 | -500 | 30 | -450 | -150 | -600 | 0 | 1.25 | △ | ○ | ○ | ×× | × | × |
| 600 | 60 | -540 | 30 | -490 | -110 | -560 | -40 | 1.34 | ○ | ◎ | ○ | ×× | △ | × |
| 600 | 40 | -560 | 30 | -510 | -90 | -540 | -60 | 1.38 | ○ | ○ | ○ | × | ○ | × |
| 600 | 0 | -600 | 30 | -550 | -50 | -500 | -100 | DISCHARGE | | | | | | |
| 600 | 140 | -460 | 40 | -410 | -190 | -640 | 40 | 1.29 | △ | × | × | ×× | × | × |
| 600 | 120 | -480 | 40 | -430 | -170 | -620 | 20 | 1.34 | ○ | △ | △ | ×× | × | × |
| 600 | 100 | -500 | 40 | -450 | -150 | -600 | 0 | 1.38 | ○ | ○ | ◎ | ×× | × | × |
| 600 | 80 | -520 | 40 | -470 | -130 | -580 | -20 | 1.42 | ○ | ◎ | ○ | ×× | × | × |
| 600 | 60 | -540 | 40 | -490 | -110 | -560 | -40 | 1.45 | △ | ◎ | ○ | × | × | × |
| 600 | 40 | -560 | 40 | -510 | -90 | -540 | -60 | 1.49 | △ | ○ | ○ | × | × | × |
| 600 | 0 | -600 | 40 | -550 | -50 | -500 | -100 | DISCHARGE | | | | | | |
| 600 | 200 | -400 | 50 | -350 | -250 | -700 | 100 | 1.29 | △ | × | × | ×× | × | × |
| 600 | 180 | -420 | 50 | -370 | -230 | -680 | 80 | 1.34 | ○ | × | × | ×× | × | × |
| 600 | 160 | -440 | 50 | -390 | -210 | -660 | 60 | 1.38 | ○ | × | × | ×× | × | × |
| 600 | 140 | -460 | 50 | -410 | -190 | -640 | 40 | 1.42 | ○ | × | × | ×× | × | × |
| 600 | 120 | -480 | 50 | -430 | -170 | -620 | 20 | 1.45 | △ | △ | △ | ×× | × | × |

FIG.21

| Vpp | V2 | V1 | Duty | V1-VL | VL-V2 | VH-V2 | V1-VH | TD | DENSITY | EVENNESS (SOLID) | EVENNESS (DOT) | FOG | REPRODUCIBILITY OF HIGHLIGHT SEC | COMPREHENSIVE EVALUATION |
|---|---|---|---|---|---|---|---|---|---|---|---|---|---|---|
| 650 | 165 | -485 | 40 | -435 | -215 | -665 | 15 | 1.28 | △ | × | × | ×× | × | × |
| 650 | 145 | -505 | 40 | -455 | -195 | -645 | -5 | 1.33 | ○ | × | × | ×× | × | × |
| 650 | 125 | -525 | 40 | -475 | -175 | -625 | -25 | 1.37 | ○ | △ | △ | ×× | × | × |
| 650 | 105 | -545 | 40 | -495 | -155 | -605 | -45 | 1.41 | ○ | △ | △ | ×× | △ | × |
| 650 | 85 | -565 | 40 | -515 | -135 | -585 | -65 | 1.44 | △ | ○ | ○ | × | ○ | × |
| 650 | 65 | -585 | 40 | -535 | -115 | -565 | -85 | DISCHARGE | | | | | | |
| 650 | 25 | -625 | 40 | -575 | -75 | -525 | -125 | DISCHARGE | | | | | | |

FIG.22

| Vpp | V2 | V1 | Duty | V1-VL | VL-V2 | VH-V2 | V1-VH | TD | DENSITY | EVENNESS (SOLID) | EVENNESS (DOT) | FOG | REPRODUCIBILITY OF HIGHLIGHT SEC. | COMPREHENSIVE EVALUATION |
|---|---|---|---|---|---|---|---|---|---|---|---|---|---|---|
| 700 | 240 | -460 | 45 | -410 | -290 | -740 | 40 | 1.26 | △ | × | × | ×× | × | × |
| 700 | 220 | -480 | 45 | -430 | -270 | -720 | 20 | 1.29 | ○ | × | × | ×× | × | × |
| 700 | 200 | -500 | 45 | -450 | -250 | -700 | 0 | 1.33 | ○ | × | × | ×× | × | × |
| 700 | 180 | -520 | 45 | -470 | -230 | -680 | -20 | 1.37 | ○ | × | × | ×× | × | × |
| 700 | 160 | -540 | 45 | -490 | -210 | -660 | -40 | 1.39 | ○ | × | × | ×× | × | × |
| 700 | 140 | -560 | 45 | -510 | -190 | -640 | -60 | 1.43 | △ | × | × | ×× | × | × |

FIG.23

<GRANULATION DEGREE>

| | | |
|---|---|---|
| GI VALUE≦0.15 | ○ | GOOD |
| 0.15-0.20 | △ | ACCEPTABLE |
| 0.20≦GI VALUE | × | BAD |

FIG.24

<GRADATION>

| | | |
|---|---|---|
| GRADATIONS 20～ | ○ | GOOD |
| 16～19 | △ | ACCEPTABLE |
| ～15 | × | BAD |

FIG.25

VH:-350V
VL:-50V

| DEVELOPMENT BIAS CONDITION | FREQUENCY | DUTY | GRANULATION | GRADATION | FOG |
|---|---|---|---|---|---|
| Vpp:600V<br>V1:−500V<br>V2:+100V | 1KHz | 20 | × | × | ×× |
| | 1.5KHz | 24 | △ | △ | △ |
| | 2KHz | 30 | ○ | ○ | ○ |
| | 3KHz | 40 | ○ | ○ | ○ |
| | 5KHz | 43 | ○ | ○ | ○ |
| | 7KHz | 45 | △ | ○ | ○ |
| Vpp:450V<br>V1:−425V<br>V2:+25V | 1KHz | 18 | × | × | ×× |
| | 1.5KHz | 21 | △ | △ | △ |
| | 2KHz | 30 | ○ | ○ | ○ |
| | 3KHz | 38 | ○ | ○ | ○ |
| | 5KHz | 42 | ○ | ○ | ○ |
| | 7KHz | 45 | △ | ○ | ○ |

FIG.26

VH:-350V
VL:-50V

| | 23°C/60%RH | 10°C/15%RH | | 30°C/85%RH | |
|---|---|---|---|---|---|
| V1 | -450 | -450 | -550 | -450 | -400 |
| V2 | 50 | 50 | 50 | 50 | 100 |
| Duty | 40 | 50 | 40 | 30 | 40 |
| \|V1-VL\| | 400 | 400 | 500 | 400 | 350 |
| \|VL-V2\| | 100 | 100 | 100 | 100 | 150 |
| \|VH-V2\| | 400 | 400 | 400 | 400 | 450 |
| \|V1-VH\| | 100 | 100 | 200 | 100 | 50 |
| TD | 1.37 | 1.35 | 1.34 | 1.41 | 1.39 |
| DENSITY | ○ | ○ | ○ | ○ | ○ |
| FOG | ○ | ○ | ○ | ○ | ○ |
| EVENNESS OF SOLID SEC. | ◎ | ◎ | ◎ | ◎ | ◎ |
| EVENNESS OF DOT SEC. | ○ | ○ | ○ | ◎ | ◎ |
| REPRODUCIBILITY OF HIGHLIGHT SEC. | ○ | ○ | ○ | ○ | ○ |

DEVELOPING APPARATUS, IMAGE FORMING APPARATUS, AND DEVELOPING METHOD

This application is based on Application No. 2004-060715 filed in Japan, contents of which are hereby incorporated by reference.

BACKGROUND OF THE INVENTION

1. Field of the Invention

The present invention relates to a developing apparatus, an image forming apparatus equipped with the developing apparatus, and developing method of those apparatuses, wherein a latent image on a photosensitive body gets developed with toner. More particularly, it relates to a developing apparatus, an image forming apparatus equipped with the developing apparatus, and developing method of those apparatuses, wherein development is made in accordance with contact developing with one-component non-magnetic toner.

2. Description of Related Art

Various proposals have conventionally been made with respect to developing apparatuses for image forming apparatuses (see JP laid-open Patent Publication No. 2003-29507, JP Patent No. 3363593, and the like). Development methods for developing apparatuses are classified into two, namely, one-component developing and two-component developing. Developer without carrier is used for one-component developing, whereas developer including toner and carrier is used for two-component developing. Since one-component developing does not need mechanism for agitating developer, it is convenient for miniaturization of mechanical structure in comparison with two-component developing. A developing apparatus of one-component developing is equipped with a regulating member for regulating thickness of a toner layer on a toner carrier.

one-component developing is further classified into two types depending on developing voltage application, namely, DC developing in which developing voltage is limited to direct current components, and AC developing in which AC bias components are superimposed on developing voltage. Furthermore, one-component developing is classified further depending on contact state of a facing portion with respect to a toner carrier and an image carrier (so-called, development region). That is, depending on contact state of the facing portion, it is classified into non-contact developing in which a predetermined space is provided between a toner carrier and an image carrier, and contact developing in which both of the carriers are in contact with each other.

Non-contact developing is excellent in reproducing of dots and fine lines because edge effect can be obtained due to space of development regions. On the other hand, as the space fluctuates, developing electrical field also fluctuates, which causes noises such as unevenness of an image and the like. This is a drawback of non-contact developing. Therefore, strict control of space accuracy is required for non-contact developing, which overloads control system. Especially, a combination of non-contact developing and AC developing overloads power system. This is because high-amplitude development bias (1 kV or higher, at peak-to-peak) is required.

On the other hand, contact developing requires comparatively less development bias. Therefore, contact developing is advantageous in terms of power load. Not to mention, contact developing does not require space control, which is another advantageous point. However, edge effect cannot be expected with contact developing. Therefore, contact developing is disadvantageous for reproducibility of dots and fine lines compared with non-contact developing. Particularly, under recent demand that resolution of about 600–1200 dpi has been required for higher image quality, contact developing faces difficulties in accurate reproduction of a highlight section and sufficient gradation degree.

Therefore, there is devised a combination of contact developing and AC developing for compromising between load on an apparatus and image quality. By doing so, it is conceived that edge effect can work for improving reproducibility of dots and fine lines despite contact developing. This is because such a method combination can make toner fly at non-contact regions upstream and downstream of a development region.

However, there have actually been difficulties in combining contact developing and AC developing. For example, a developing apparatus of JP laid-open Patent Publication No. 2003-29507 tends to create unevenness of image density when AC bias is set high. Furthermore, application of contact developing and one-component developing to this developing apparatus causes current leakage between its image carrier and development member, which results in fog on a background section of an image. In this developing apparatus, an absolute value of voltage difference between peak voltage V1 for development bias and imaging section voltage VL for an image carrier is set to 600 V or higher and this absolute value is considered to be too large for contact developing. Furthermore, application of one-component developing to a developing apparatus of JP Patent No. 3363593 results in poor reproducibility of a highlight section in an image due to the above-described reason, which is problematic.

SUMMARY OF THE INVENTION

The present invention has been made to resolve the problems the above-mentioned conventional developing apparatuses have had. That is, it is intended to provide a developing apparatus, an image forming apparatus and developing method capable of managing both decrease of load on apparatuses and improvement of image quality in case development of an image is made by applying contact developing and AC developing.

According to the aspect of the present invention, there is provided a developing apparatus comprising: a development member for developing an electrostatic latent image on an image carrier by applying one-component non-magnetic toner, the development member being in contact with the image carrier; a regulating member for regulating thickness of toner layer on the development member; and a voltage applier for applying bias voltage to a portion between the development member and the image carrier, the bias voltage oscillating between voltages V1 and V2. In the developing apparatus, voltage V1 satisfies all of conditions (1) through (3), and voltages V1 and VH exhibit homopolarity with reference to voltage Vg, $$|VH - Vg| < |V1 - Vg| \tag{1}$$

$$350\ V \leqq |V1 - VL| \leqq 500\ V \tag{2}$$

$$\left.\begin{array}{l} VH - 200\ V \leqq V1\ \text{(in case } VH < 0) \\ V1 \leqq VH + 200\ V\ \text{(in case } VH > 0) \end{array}\right\} \tag{3}$$

voltage V2 satisfies both conditions (4) and (5), and voltages V2 and V1 exhibit antipolarity with reference to voltage VL, $$70\ V \leqq |V2 - VL| \leqq 150\ V \tag{4}$$

$$\left.\begin{array}{l} V2 \leqq VH + 500\ V\ \text{(in case } VH < 0) \\ VH - 500\ V \leqq V2\ \text{(in case } VH > 0) \end{array}\right\} \tag{5}$$

and above notations represent

Vg: ground voltage,

VH: voltage of a background section in an electrostatic latent image formed on the image carrier, and VL: voltage of a visible section in an electrostatic latent image formed on the image carrier, VL and VH exhibit homopolarity with reference to Vg, and a condition $|VL-Vg|<|VH-Vg|$ is satisfied.

Thereby, in the inventive developing apparatus, leakage never occurs at a portion between the image carrier and the development member and edge effect by toner flying can be expected at upstream and downstream of a development region where the image carrier and development member are in contact with each other. Therefore, fog at a background section is unlikely to occur and reproducibility of dots and fine line is high. Furthermore, since the invention adopts contact developing, unevenness of image density is unlikely to occur. The invention makes it possible to form a high-quality image without putting high load on control system and power source system.

The one aspect of the present invention also encompasses an image forming apparatus comprising: an image carrier; charger for getting a surface of the image carrier charged; an exposer for exposing charged surface of the image carrier and forming an electrostatic latent image; and the above mentioned developing apparatus.

The one aspect of the present invention also encompasses a developing method for an electrophotograph-type image forming apparatus, comprising: process of forming one-component non-magnetic toner layer on a development member; and process of developing an electrostatic latent image by applying bias voltage to a portion between the development member and an image carrier, the bias voltage oscillating between voltages V1 and V2, the development member being in contact with the image carrier on which an electrostatic latent image is formed. Notations and expressions (1) through (5) of the inventive developing apparatus are applied to the developing method.

The present invention thus provides a developing apparatus, an image forming apparatus and developing method capable of managing both decrease of load on apparatuses and improvement of image quality in case development of an image is made by applying contact developing and AC developing, as well.

BRIEF DESCRIPTION OF DRAWINGS

For a better understanding of the present invention, reference is made to the following detailed description of the invention, just in conjunction with the accompanying drawings in which:

FIG. 3 is a table showing ranking classification and evaluation symbols with respect to transmittance factor density value of an image;

FIG. 4 is a table showing and evaluation symbols with respect to evenness of image;

FIG. 5 is a table showing ranking classification and evaluation symbols with respect to fog;

FIG. 6 is a table showing ranking classification and evaluation symbols with respect to reproducibility of high-light section;

FIG. 7 is a table showing ranking classification and evaluation symbols with respect to comprehensive evaluation;

FIG. 8 is a table of a test result on condition VH=−300V, VL=−50V, Vpp=400V, 40% duty ratio;

FIG. 9 is a table of a test result on condition VH=−300V, VL=−50V, Vpp=450V, 25–50% duty ratio;

FIG. 10 is a table of a test result on condition VH=−300V, VL=−50V, Vpp=600V, 25–50% duty ratio;

FIG. 11 is a table of a test result on condition VH=−300V, VL=−50V, Vpp=650V, 40% duty ratio;

FIG. 12 is a table of a test result on condition VH=−300V, VL=−50V, Vpp=700V, 45% duty ratio;

FIG. 13 is a table of a test result on condition VH=−400V, VL=−50V, Vpp=400V, 40% duty ratio;

FIG. 14 is a table of a test result on condition VH=−400V, VL=−50V, Vpp=450V, 25–50% duty ratio;

FIG. 15 is a table of a test result on condition VH=−400V, VL=−50V, Vpp=600V, 25–50% duty ratio;

FIG. 16 is a table of a test result on condition VH=−400V, VL=−50V, Vpp=650V, 40% duty ratio;

FIG. 17 is a table of a test result on condition VH=−400V, VL=−50V, Vpp=700V, 45% duty ratio;

FIG. 18 is a table of a test result on condition VH=−500V, VL=−50V, Vpp=400V, 40% duty ratio;

FIG. 19 is a table of a test result on condition VH=−500V, VL=−50V, Vpp=450V, 25–50% duty ratio;

FIG. 20 is a table of a test result on condition VH=−500V, VL=−50V, Vpp=600V, 25–50% duty ratio;

FIG. 21 is a table of a test result on condition VH=−500V, VL=−50V, Vpp=650V, 40% duty ratio;

FIG. 22 is a table of a test result on condition VH=−500V, VL=−50V, Vpp=700V, 45% duty ratio;

FIG. 23 is a table showing ranking classification and evaluation symbols with respect to granulation degree of an image;

FIG. 24 is a table showing ranking classification and evaluation symbols with respect to gradation degree of an image;

FIG. 25 is a table of test results obtained by changing frequency;

FIG. 26 is a table of test results obtained by changing development conditions depending on temperature and humidity.

DETAILED DESCRIPTION OF PREFERRED EMBODIMENTS

Figure 1:
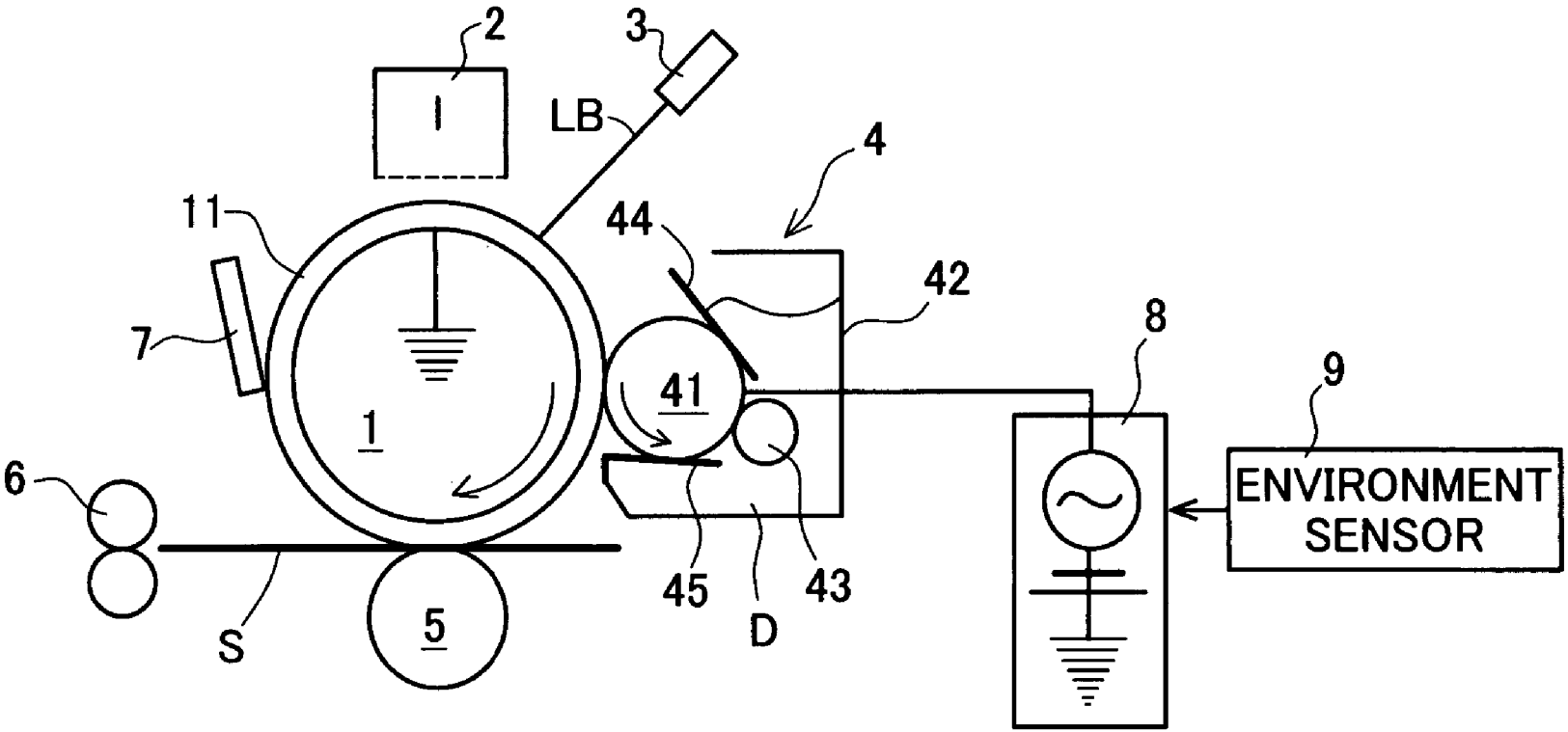
FIG. 1 is a structure diagram showing main part of a laser-beam printer directed to an embodiment.

Here will be described preferred embodiments of the present invention in detail by referring to drawings. This embodiment corresponds to a laser-beam printer to which the present invention is applied. FIG. 1 shows a main part of the laser-beam printer of this embodiment. The laser-beam printer of FIG. 1 includes a photosensitive drum 1, a charger 2, an exposure section 3, a developing apparatus 4, an image transfer roller 5, a fixer 6, a cleaner 7, a power supply section 8, and an environment sensor 9.

The photosensitive drum 1 is an image carrier on which a photosensitive layer 11 is formed. To be more specific, the photosensitive drum 1 is a cylinder shaped drum made of electrically conductive material such as aluminum, of which periphery is coated with a photosensitive layer (charged-to-negative-polarity type, herein). The photosensitive drum 1 rotates in an arrow direction at rotation speed which coincides with peripheral speed corresponding to process speed (100 mm/sec).

The charger 2 gets the photosensitive layer 11 on the photosensitive drum 1 charged to predetermined level of voltage. The exposure section 3 writes an electrostatic latent image on the photosensitive layer 11 after get charged. Therefore, the exposure section 3 irradiate laser beam LB on the photosensitive layer 11 in accordance with time-series-digital pixel signals based on image data.

The developing apparatus 4 gets an electrostatic latent image on the photosensitive layer 11 developed by applying one-component non-magnetic negative polarity toner to the electrostatic latent image. Therefore, the developing apparatus 4 includes a developing roller 41 for carrying toner layer of predetermined thickness on its surface. The developing roller 41 is a rubber roller coated with a surface electrical resistance layer (thickness: 5 μm–30 μm, volume resistivity $10^{11}$–$10^{12}$). The developing roller 41 and the photosensitive drum 1 are disposed in contact with each other. The developing roller 41 rotates in direction opposite to rotating direction of the photosensitive drum 1. As to rotation of the developing roller 41, its peripheral speed (150 mm/sec, herein) is set to take predetermined speed difference with reference to peripheral speed of the photosensitive drum 1.

The developing apparatus 4 further includes a toner storage 42, a supply roller 43, a regulating plate 44, and a decharging seal 45. The supply roller 43 supplies toner D stored in the toner storage 42 to the developing roller 41. The regulating plate 44 regulates thickness of a toner layer on the developing roller 41. Bias is applied to the supply roller 43 and the regulating plate 44 so as to form an electric field which urges toner with reference to the developing roller 41. The decharging seal 45 prevents toner D in the toner storage 42 from leaking out at a portion to which toner remaining on the developing roller 41 after development is collected to the toner storage 42. Furthermore, the decharging seal 45 works to eliminate static charge from toner remaining after development, as well. Bias is applied to the decharging seal 45 so that an electric field to eliminate charge from toner remaining after development is formed with reference to the developing roller 41, or the decharging seal 45 may be short-circuited to the developing roller 41.

The image transfer roller 5 transfers a toner image, obtained by development, from the photosensitive layer 11 to an image transfer medium S. The fixer 6 fixes the toner image transferred onto the image transfer medium S. The cleaner 7 eliminates toner remaining on the photosensitive layer 11 after transfer for next image formation.

The power supply section 8 applies developing voltage to the developing apparatus 4. The power supply section 8 applies oscillatory voltage VB (=VDC+VAC), obtained by superimposing direct current voltage VDC and rectangular-wave-formed alternating current voltage VA, between the developing roller 41 and the photosensitive drum 1. In the power supply section 8, a value of direct current voltage VDC (see FIG. 2) and amplitude of alternating current voltage VAC (in FIG. 2, Vpp (=|V1−V2|), V1 and V2 are peak voltages, V1<V2)) are independently controllable. Furthermore, as to alternating current voltage VAC, frequency (expressed as "1/(T1+T2)", by using T1 and T2 in FIG. 2) and duty ratio (expressed as "T1/(T1+T2)", by using T1 and T2 in FIG. 2) are controllable in independent of other parameters. T1 in FIG. 2 corresponds to duration of peak voltage V1 during one cycle of alternating current voltage VAC. T2 corresponds to duration of peak voltage V2 during one cycle of alternating current voltage VAC.

Figure 2:
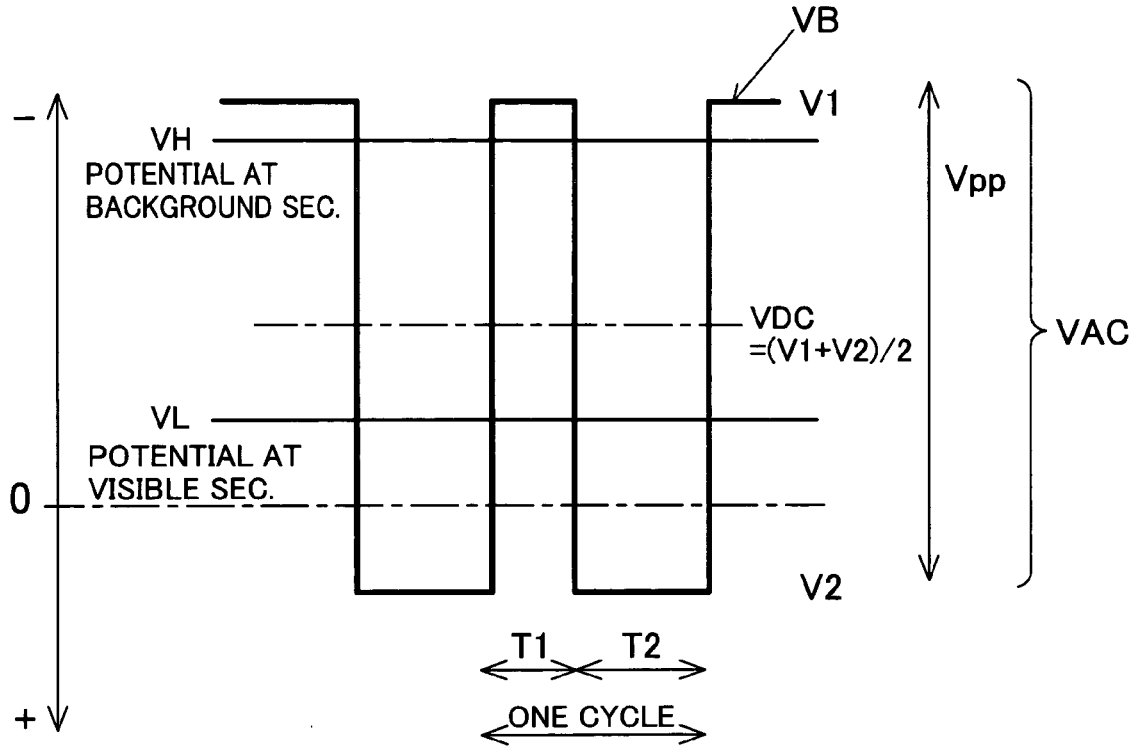
FIG. 2 is a graph accounting for various parameters of bias applied to the developing apparatus directed to the embodiment.

Point "0" on a vertical axis in FIG. 2 corresponds to ground voltage. VH corresponds to voltage at a background section on the photosensitive layer 11 after exposure. VL corresponds to voltage at a visible section on the photosensitive layer 11 after exposure. Furthermore, FIG. 2 teaches the following relation of respective voltages.

[1] Polarity of voltages V1, VH, VDC, and VL is same with reference to ground voltage as criterion.

[2] Polarity of voltage V2 is reversed polarity to polarity of voltage V1 with reference to voltage VL as criterion.

[3] An absolute value of voltage VH (an absolute value with reference to ground voltage, here, and as long as no particular notation, meaning of absolute value will be regarded similarly hereinafter) is larger than that of voltage VL, and an absolute value of voltage V1 is further larger than that of voltage VH.

The environment sensor 9 obtains environment values, namely, values of temperature and humidity. An output signal from the environment sensor 9 is inputted to the power supply section 8. Thereby, the power supply section 8 can control the above-mentioned various parameters depending on environment condition.

There will be described application bias to the developing apparatus 4, applied by the power supply section 8 in the above-such-structured laser-beam printer of this embodiment. In addition to the above-mentioned relations [1] through [3], oscillatory voltage VB is applied so as satisfy the following conditions.

[4] An absolute value of voltage difference between voltages V1 and VL is within a range of 350V–500V.

[5] An absolute value of voltage difference between voltages V1 and VH is within a range of 50V–200V.

[6] An absolute value of voltage difference between voltages V2 and VL is within a range of 70V–150V.

[7] An absolute value of voltage difference between voltages V2 and VH does not exceed 500V.

For clarifying reason of those conditioning, image quality tests were conducted by changing parameters variously. There will be described the test results. In those tests, fineness of image formation was set to 600 dpi.

Firstly, there will be described test results obtained by changing peak voltages V1 and V2 variously. In the tests, images formed under 3-kHz-frequency oscillatory voltage VB were evaluated. As items for quality evaluation, there are image density, evenness of solid section, evenness of dot section, fog, and reproducibility of highlight section. Respective items were evaluated in the following ways.

Image density: output a solid image, measured its transmittance density with a Macbeth densitometer (TD904, product of Gretag Macbeth LLC), and classified density values into five ranges as shown in FIG. 3.

Evenness of solid section: output a solid image, and made ranking evaluations with symbols as shown in FIG. 4 basing on density-unevenness measurement and visual-check evaluation.

Evenness of dot section: output a halftone dot image, and made ranking evaluations with symbols as shown in FIG. 4, basing on measurement of halftone dot diameter unevenness and visual-check evaluation.

Fog: peeled off tape (book tape: Amenity B coat, product of KIHARA Corp.) to take toner at a portion of background section voltage VH on the photosensitive layer 11, stuck the peeled tape on paper of which whiteness degree is 70, measured fog degree (C* measurement) with colorimeter-color difference meter (CR-241, product of Minolta Co., Ltd.), and made ranking evaluations as shown in FIG. 5.

Highlight section reproducibility: output a 32-stage gradation pattern and made ranking evaluations with respect to reproducibility of 1st and 2nd stages of highlight sections in the outputted gradation pattern with symbols as shown in FIG. 6.

Furthermore, comprehensive evaluations are made based on the above five evaluation items, following table shown in FIG. 7.

FIG. 8 through FIG. 12 show test results obtained on condition that voltages VH and VL are set to −300V and −50V, respectively. These tables also show respective voltage difference values of "V1−VL", "VL−V2", "VH−V2", and "V1−VH" under the respective conditioned tests (similar to FIG. 13 through FIG. 22).

FIG. 8 shows test results obtained on condition Vpp=400V and 40% duty ratio. In the tests of FIG. 8, peak voltage V1 is ranged from −300V to −460V by seven levels as shown. In accordance with that, peak voltage V2 is ranged from 100V to −60V, by seven levels as shown. The table of FIG. 8 indicates the followings.

Image density: acceptable or good for practical use in case peak voltage V1 is within a range from −340V to −420V, however, bad for practical use out of the above specified range.

Evenness of solid section: acceptable or very good for practical use in case peak voltage V1 is −400V or higher, particularly very good within a range from −340V to −380V, however, bad for practical use in case of −420V or lower.

Evenness of dot section: acceptable or good for practical use in case peak voltage V1 is −380V or lower, however, bad for practical use in case of −360V or higher.

Fog: very good for practical use on the whole, and particularly very good in case peak voltage V1 is −360V or lower.

Highlight section reproducibility: acceptable or good for practical use in case peak voltage V1 is −340V or lower, however, bad for practical use in case of −300V.

Comprehensive evaluation: good for practical use in case peak voltage V1 is −380V and −400V but bad for practical use in case of other than the above specified two values.

FIG. 9 shows test results obtained on condition Vpp=450V and 25–50% duty ratio. In the tests of FIG. 9, duty ratio is ranged from 25% to 50% by four levels as shown. Furthermore, under 25%-duty-ratio conditioning, peak voltage V1 is ranged from −325V to −525V by six levels as shown. In accordance with that, peak voltage V2 is ranged from 125V to −75V by six levels as shown. Under 30%-duty-ratio conditioning, peak voltage V1 is ranged from −385V to −485V by six levels as shown. In accordance with that, peak voltage V2 is ranged from 65V to −35V by six levels as shown. Under 40%-duty-ratio conditioning, peak voltage V1 is ranged from −325V to −485V by six levels as shown. In accordance with that, peak voltage V2 is ranged from 125V to −35V by six levels as shown. Under 50%-duty-ratio conditioning, peak voltage V1 is ranged from −325V to −425V by five levels as shown. In accordance with that, peak voltage V2 is ranged from 125V to 25V by five levels as shown.

Test results under 25%-duty-ratio conditioning shown in the table of FIG. 9 indicate the followings.

Image density: acceptable or very good for practical use in case peak voltage V1 is −425V or lower, however, bad for practical use in case of −385V or higher.

Evenness of solid section: acceptable or very good for practical use in case peak voltage V1 is −445V or higher, however, bad for practical use in case of −465V or lower.

Evenness of dot section: acceptable or good for practical use in case peak voltage V1 is −385V or lower, however, bad for practical use in case of −325V.

Fog: very good or acceptable for practical use on the whole, and particularly very good in case peak voltage V1 is within a range from −425V to −465V.

Highlight section reproducibility: acceptable or good for practical use in case peak voltage V1 is −385V or lower, however, bad for practical use in case of −325V.

Comprehensive evaluation: good for practical use in case peak voltage V1 is −425V and acceptable in case of −400V but bad for practical use in case of other than the above specified two values.

Test results under 30%-duty-ratio conditioning shown in the table of FIG. 9 indicate the followings.

Image density: acceptable or very good for practical use in case peak voltage V1 is −405V or lower, however, bad for practical use in case of −385V.

Evenness of solid section: acceptable or very good for practical use in case peak voltage V1 is −445V or higher, and particularly very good in case of −425V, however, bad for practical use in case of −465V or lower.

Evenness of dot section: acceptable or very good for practical use on the whole and particularly very good in case peak voltage V1 is −425V.

Fog: very good for practical use on the whole.

Highlight section reproducibility: good for practical use in case peak voltage V1 is −405V or lower, however, bad for practical use in case of −385V.

Comprehensive evaluation: good for practical use in case peak voltage V1 is within a range from −405V to −445V, particularly very good in case of −425V, however, bad for practical use in case of out of the above specified range.

Test results under 40%-duty-ratio conditioning shown in the table of FIG. 9 indicate the followings.

Image density: acceptable or good for practical use in case peak voltage V1 is within a range from −365V to −445V, however, bad for practical use in case of out of the above specified range.

Evenness of solid section: acceptable or very good for practical use in case peak voltage V1 is −445V or higher, particularly very good in case of −425V and −405V, however, bad for practical use in case of −485V.

Evenness of dot section: acceptable or good for practical use in case peak voltage V1 is −365V or lower, however, bad for practical use in case of −325V.

Fog: very good for practical use on the whole, particularly very good in case peak voltage V1 is −425V or lower.

Highlight section reproducibility: good for practical use in case peak voltage V1 is −365V or lower, however, bad for practical use in case of −325V.

Comprehensive evaluation: very good for practical use in case peak voltage V1 is −405V and −425V, acceptable in case of −365V and −445V, however, bad for practical use in case of other than the above specified values.

Test results under 50%-duty-ratio conditioning shown in the table of FIG. 9 indicate the followings.

Image density: acceptable or good for practical use on the whole.

Evenness of solid section: acceptable or very good for practical use on the whole, and particularly very good in case peak voltage V1 is −385V and −405V.

Evenness of dot section: acceptable or very good for practical use in case peak voltage V1 is −385V or lower, particularly very good in case of −425V, however, bad for practical use in case of −365V or higher.

Fog: very good for practical use on the whole, particularly very good in case peak voltage V1 is −425V.

Highlight section reproducibility: good for practical use in case peak voltage V1 is −365V or lower, however, bad for practical use in case of −325V.

Comprehensive evaluation: good for practical use in case peak voltage V1 is −385V or lower, however, bad for practical use in case of −365V or higher.

FIG. 10 shows test results obtained on condition Vpp=600V and 25–50% duty ratio. In the tests of FIG. 10, duty ratio is ranged from 25% to 50% by four levels as shown. Furthermore, under 25%-duty-ratio conditioning, peak voltage V1 is ranged from −460V to −600V by six levels as shown. In accordance with that, peak voltage V2 is ranged from 140V to 0V by six levels as shown. Under 30%-duty-ratio conditioning, peak voltage V1 is ranged from −460V to −600V by six levels as shown. In accordance with that, peak voltage V2 is ranged from 140V to 0V by six levels as shown. Under 40%-duty-ratio conditioning, peak voltage V1 is ranged from −460V to −600V by seven levels as shown. In accordance with that, peak voltage V2 is ranged from 140V to 0V by seven levels as shown. Under 50%-duty-ratio conditioning, peak voltage V1 is ranged from −400V to −480V by five levels as shown. In accordance with that, peak voltage V2 is ranged from 200V to 120V by five levels as shown.

Test results under 25%-duty-ratio conditioning shown in the table of FIG. 10 indicate the followings. It is to be noted since discharge occurred when peak voltage V1 was set to −600V, it is out of evaluation at the level of V1=−600V.

Image density: good for practical use in case peak voltage V1 is −560V, however, bad for practical use in case of −520V or higher.

Evenness of solid section: acceptable or very good for practical use in case peak voltage V1 is −480V or lower, particularly very good in case of −520V, however, bad for practical use in case of −460V.

Evenness of dot section: acceptable or good for practical use in case peak voltage V1 is −480V or lower, however, bad for practical use in case of −460V.

Fog: acceptable or good for practical use in case peak voltage V1 is −520V or higher, however, bad for practical use in case of −560V.

Highlight section reproducibility: acceptable or good for practical use in case peak voltage V1 is −520V or lower, however, bad for practical use in case of −500V or higher.

Comprehensive evaluation: bad for practical at any case.

Test results under 30%-duty-ratio conditioning shown in the table of FIG. 10 indicate the followings. It is to be noted since discharge occurred when peak voltage V1 was set to −600V, it is out of evaluation at the level of V1=−600V.

Image density: acceptable or very good for practical use in case peak voltage V1 is −500V or lower, however, bad for practical use in case of −480V or higher.

Evenness of solid section: acceptable or very good for practical use in case peak voltage V1 is −480V or lower, particularly very good in case of −540V, however, bad for practical use in case of −460V.

Evenness of dot section: acceptable or good for practical use in case peak voltage V1 is −480V or lower, however, bad for practical use in case of −460V.

Fog: acceptable or good for practical use in case peak voltage V1 is −540V or higher, however, bad for practical use in case of −560V.

Highlight section reproducibility: acceptable or good for practical use in case peak voltage V1 is −500V or lower, however, bad for practical use in case of −480V or higher.

Comprehensive evaluation: good for practical use in case peak voltage V1 is −540V, acceptable in case of −500V, however, bad for practical use in case other than the above specified values.

Test results under 40%-duty-ratio conditioning. shown in the table of FIG. 10 indicate the followings. It is to be noted since discharge occurred when peak voltage V1 was set to −600V, it is out of evaluation at the level of V1=−600V.

Image density: acceptable or good for practical use at any levels within the designated range of peak voltage V1.

Evenness of solid section: acceptable or very good for practical use in case peak voltage V1 is −480V or lower, particularly very good in case of −520V and −540V, however, bad for practical use in case of −460V.

Evenness of dot section: acceptable or very good for practical use in case peak voltage V1 is −480V or lower, particularly very good in case of −500V, however, bad for practical use in case of −460V.

Fog: acceptable or good for practical use in case peak voltage V1 is −520V or higher, however, bad for practical use in case of −540V or lower.

Highlight section reproducibility: good for practical use at any levels within the designated range of peak voltage V1.

Comprehensive evaluation: acceptable or very good for practical use in case peak voltage V1 is within a range from −480V to −520V, particularly very good in case of −500V, however, bad for practical use in case of other than the above specified values.

Test results under 50%-duty-ratio conditioning shown in the table of FIG. 10 indicate the followings.

Image density: acceptable or good for practical use at any levels within the designated range of peak voltage V1.

Evenness of solid section: acceptable for practical use in case peak voltage V1 is −480V, however, bad for practical use in case of −460V or higher.

Evenness of dot section: acceptable for practical use in case peak voltage V1 is −480V, however, bad for practical use in case of −460V or higher.

Fog: acceptable or good for practical use at any levels within the designated range of peak voltage V1.

Highlight section reproducibility: good for practical use at any levels within the designated range of peak voltage V1.

Comprehensive evaluation: acceptable for practical use in case peak voltage V1 is −480V, however, bad for practical use in case of any values other than −480V.

FIG. 11 shows test results obtained on condition Vpp=650V and 40% duty ratio. In the tests of FIG. 11, peak voltage V1 is ranged from −485V to −625V by seven levels as shown. In accordance with that, peak voltage V2 is ranged from 165V to 25V by seven levels as shown. The table of FIG. 11 indicates the followings. It is to be noted since discharge occurred when peak voltage V1 was set to −585V or lower, it is out of evaluation at the level of V1=−585V or lower.

Image density: acceptable or good for practical use in case peak voltage V1 is −565V or higher which is a whole range excluding the out-of-evaluation range, −585V or lower.

Evenness of solid section: acceptable or good for practical use in case peak voltage V1 is within a range from −525V to −565V, however, bad for practical use in case of −505V or higher.

Evenness of dot section: acceptable or good for practical use in case peak voltage V1 is within a range from −525V to −565V, however, bad for practical use in case of −505V or higher.

Fog: acceptable or good for practical use in case peak voltage V1 is −525V or higher, however, bad for practical use in case of −545V or lower.

Highlight section reproducibility: good for practical use in case peak voltage V1 is at any level within a range of −565V or higher.

Comprehensive evaluation: bad for practical use in case peak voltage V1 is at any level with −565V or higher.

FIG. 12 shows test results obtained on condition Vpp=700V and 45% duty ratio. In the tests of FIG. 12, peak voltage V1 is ranged from −460V to −560V by six levels as shown. In accordance with that, peak voltage V2 is ranged from 240V to 140V by six levels as shown. The table of FIG. 12 indicates the followings.

Image density: acceptable or good for practical use at any levels within the designated range of peak voltage V1.

Evenness of solid section: bad for practical use at any levels within the designated range of peak voltage V1.

Evenness of dot section: bad for practical use at any levels within the designated range of peak voltage V1.

Fog: acceptable or good for practical use in case peak voltage V1 is within a range from −480V to −520V, however, bad for practical use in case of other than the above specified three values.

Highlight section reproducibility: good for practical use at any levels within the designated range of peak voltage V1.

Comprehensive evaluation: bad for practical use at any levels within the designated range of peak voltage V1.

FIG. 13 through FIG. 17 show test results obtained on condition that voltages VH and VL are set to −400V and −50V, respectively.

FIG. 13 shows test results obtained on condition Vpp=400V and 40% duty ratio. In the tests of FIG. 13, peak voltage V1 is ranged from −300V to −460V by seven levels as shown. In accordance with that, peak voltage V2 is ranged from 100V to −60V by seven levels as shown. The table of FIG. 13 indicates the followings.

Image density: acceptable or good for practical use in case peak voltage V1 is within a range from −340V to −420V, however, bad for practical use out of the above specified range.

Evenness of solid section: acceptable or very good for practical use in case peak voltage V1 is −400V or higher, particularly very good within a range from −340V to −380V, however, bad for practical use in case of −420V or lower.

Evenness of dot section: acceptable or good for practical use in case peak voltage V1 is −380V or lower, however, bad in case of −360V or higher.

Fog: good for practical use on the whole, and particularly very good in case peak voltage V1 is −360V or lower.

Highlight section reproducibility: good for practical use in case peak voltage V1 is −460V, however, bad for practical use in case of −420V or higher.

Comprehensive evaluation: bad for practical use for any cases.

FIG. 14 shows test results obtained on condition Vpp=450V and 25%–50% duty ratio. In the tests of FIG. 14, duty ratio is ranged from 25% to 50% by four levels as shown. Furthermore, under 25%-duty-ratio conditioning, peak voltage V1 is ranged from −325V to −525V by six levels as shown. In accordance with that, peak voltage V2 is ranged from 125V to −75V by six levels as shown. Under 30%-duty-ratio conditioning, peak voltage V1 is ranged from −385V to −485V by six levels as shown. In accordance with that, peak voltage V2 is ranged from 65V to −35V by six levels as shown. Under 40%-duty-ratio conditioning, peak voltage V1 is ranged from −325V to −485V by six levels as shown. In accordance with that, peak voltage V2 is ranged from 125V to −35V by six levels as shown. Under 50%-duty-ratio conditioning, peak voltage V1 is ranged from −325V to −425V by five levels as shown. In accordance with that, peak voltage V2 is ranged from 125V to 25V by five levels as shown.

Test results under 25%-duty-ratio conditioning shown in the table of FIG. 14 indicate the followings.

Image density: acceptable or very good for practical use in case peak voltage V1 is −425V or lower, however, bad for practical use in case of −385V or higher.

Evenness of solid section: acceptable or very good for practical use in case peak voltage V1 is −445V or higher, however, bad for practical use in case of −465V or lower.

Evenness of dot section: acceptable or good for practical use in case peak voltage V1 is −385V or lower, however, bad for practical use in case of −325V.

Fog: good for practical use in case peak voltage V1 is −385V, particularly very good in case peak voltage V1 is −425V or lower, however, bad in case of −325V.

Highlight section reproducibility: acceptable or good for practical use in case peak voltage V1 is −445V or lower, however, bad for practical use in case of −425V or higher.

Comprehensive evaluation: bad for practical use on the whole.

Test results under 30%-duty-ratio conditioning shown in the table of FIG. 14 indicate the followings.

Image density: acceptable or very good for practical use in case peak voltage V1 is −405V or lower, however, bad for practical use in case of −385V.

Evenness of solid section: acceptable or very good for practical use in case peak voltage V1 is −445V or higher, particularly very good in case of −425V, however, bad for practical use in case of −465V or lower.

Evenness of dot section: acceptable or very good for practical use on the whole and particularly very good in case peak voltage V1 is −425V.

Fog: very good for practical use on the whole.

Highlight section reproducibility: acceptable or good for practical use in case peak voltage V1 is −445V or lower, however, bad for practical use in case of −425V or higher.

Comprehensive evaluation: acceptable for practical use in case peak voltage V1 is −445V, however, bad for practical use in case of values other than −445V.

Test results under 40%-duty-ratio conditioning shown in the table of FIG. 14 indicate the followings.

Image density: acceptable or good for practical use in case peak voltage V1 is within a range from −365V to −445V, however, bad for practical use in case of out of the above range.

Evenness of solid section: acceptable or good for practical use in case peak voltage V1 is −445V or higher, particularly very good in case of −425V and −405V, however, bad for practical use in case of −485V.

Evenness of dot section: acceptable or very good for practical use in case peak voltage V1 is −365V or lower, however, bad for practical use in case of −325V.

Fog: good for practical use on the whole, particularly very good in case peak voltage V1 is −425V or lower.

Highlight section reproducibility: acceptable for practical use in case peak voltage V1 is −445V, good in case of −485V, however, bad for practical use in case of −425V or higher.

Comprehensive evaluation: bad for practical use on the whole.

Test results under 50%-duty-ratio conditioning shown in the table of FIG. 14 indicate the followings.

Image density: acceptable or good for practical use on the whole.

Evenness of solid section: acceptable or very good for practical use on the whole, and particularly very good in case peak voltage V1 is −405V.

Evenness of dot section: acceptable or very good for practical use in case peak voltage V1 is −385V or lower, particularly very good in case of −425V, however, bad for practical use in case of −365V or higher.

Fog: good for practical use on the whole, particularly very good in case peak voltage V1 is −425V.

Highlight section reproducibility: bad for practical use at any values of peak voltage V1.

Comprehensive evaluation: bad for practical use on the whole.

FIG. 15 shows test results obtained on condition Vpp=600V and 25%–50% duty ratio. In the tests of FIG. 15, duty ratio is ranged from 25% to 50% by four levels as shown. Furthermore, under 25%-duty-ratio conditioning, peak voltage V1 is ranged from −460V to −600V by six levels as shown. In accordance with that, peak voltage V2 is ranged from 140 V to 0 V by six levels as shown. Under 30%-duty-ratio conditioning, peak voltage V1 is ranged from −460V to −600V by six levels as shown. In accordance with that, peak voltage V2 is ranged from 140V to 0V by six levels as shown. Under 40%-duty-ratio conditioning, peak voltage V1 is ranged from −460V to −600V by seven levels as shown. In accordance with that, peak voltage V2 is ranged from 140V to 0V by seven levels as shown. Under 50%-duty-ratio conditioning, peak voltage V1 is ranged from −400V to −480V by five levels as shown. In accordance with that, peak voltage V2 is ranged from 200V to 120V by five levels as shown.

Test results under 25%-duty-ratio conditioning shown in the table of FIG. 15 indicate the followings. It is to be noted since discharge occurred when peak voltage V1 was set to −600V, it is out of evaluation at the level of V1=−600V.

Image density: good for practical use in case peak voltage V1 is −560V, however, bad for practical use in case of −520V or higher.

Evenness of solid section: acceptable or very good for practical use in case peak voltage V1 is −480V or lower, particularly very good in case of −520V, however, bad for practical use in case of −460V.

Evenness of dot section: acceptable or good for practical use in case peak voltage V1 is −480V or lower, however, bad in case of −460V.

Fog: good for practical use in case peak voltage V1 is −500V or lower, however, bad for practical use in case of −480V or higher.

Highlight section reproducibility: good for practical use in case peak voltage V1 is −520V or lower, however, bad for practical use in case of −500V or higher.

Comprehensive evaluation: good for practical use in case peak voltage V1 is −560V, however, bad for practical use at any levels of peak voltage V1 other than −560V.

Test results under 30%-duty-ratio conditioning shown in the table of FIG. 15 indicate the followings. It is to be noted since discharge occurred when peak voltage V1 was set to −600V, it is out of evaluation at the level of V1=−600V.

Image density: acceptable or very good for practical use in case peak voltage V1 is −500V or lower, however, bad for practical use in case of −480V or higher.

Evenness of solid section: acceptable or very good for practical use in case peak voltage V1 is −480V or lower, particularly very good in case of −540V, however, bad for practical use in case of −460V.

Evenness of dot section: acceptable or good for practical use in case peak voltage V1 is −480V or lower, however, bad for practical use in case of −460V.

Fog: acceptable or good for practical use in case peak voltage V1 is −480V or lower, however, bad for practical use in case of −460V.

Highlight section reproducibility: acceptable or good for practical use in case peak voltage V1 is −480V or lower, however, bad for practical use in case of −460V.

Comprehensive evaluation: good for practical use in case peak voltage V1 is −500V, particularly very good in case of −540V or lower, however, bad for practical use in case of −480V or higher.

Test results under 40%-duty-ratio conditioning shown in the table of FIG. 15 indicate the followings. It is to be noted since discharge occurred when peak voltage V1 was set to −600V, it is out of evaluation at the level of V1=−600V.

Image density: acceptable or good for practical use at any levels within the designated range of peak voltage V1.

Evenness of solid section: acceptable or very good for practical use in case peak voltage V1 is −480V or lower, particularly very good in case of −520V and −540V, however, bad for practical use in case of −460V.

Evenness of dot section: acceptable or very good for practical use in case peak voltage V1 is −480V or lower, particularly very good in case of −500V, however, bad for practical use in case of −460V.

Fog: acceptable or good for practical use in case peak voltage V1 is −480V or lower, however, bad for practical use in case of −460V lower.

Highlight section reproducibility: good for practical use at any levels within the designated range of peak voltage V1.

Comprehensive evaluation: acceptable or good for practical use in case peak voltage V1 is −500V or lower, particularly very good in case of −520V, however, bad for practical use in case of −480V or higher.

Test results under 50%-duty-ratio conditioning shown in the table of FIG. 15 indicate the followings.

Image density: acceptable or good for practical use at any levels within the designated range of peak voltage V1.

Evenness of solid section: acceptable for practical use in case peak voltage V1 is −480V, however, bad for practical use in case of −460V or higher.

Evenness of dot section: acceptable for practical use in case peak voltage V1 is −480V, however, bad for practical use in case of −460V or higher.

Fog: very bad for practical use at any levels within the designated range of peak voltage V1.

Highlight section reproducibility: good for practical use in case peak voltage V1 is −460V or lower, however, bad for practical use in case of −440V or higher.

Comprehensive evaluation: bad for practical on the whole.

FIG. 16 shows test results obtained on condition Vpp=650V and 40% duty ratio. In the tests of FIG. 16, peak voltage V1 is ranged from −485V to −625V by seven levels as shown. In accordance with that, peak voltage V2 is ranged from 165V to 25V by seven levels as shown. The table of FIG. 16 indicates the followings. It is to be noted since discharge occurred when peak voltage V1 was set to −585V or lower, it is out of evaluation at the level of V1=−585V or lower.

Image density: acceptable or good for practical use in case peak voltage V1 is −565V or higher which is a whole range excluding the out-of-evaluation range, −585V or lower.

Evenness of solid section: acceptable or good for practical use in case peak voltage V1 is within a range from −525V to −565V, however, bad for practical use in case of −505V or higher.

Evenness of dot section: acceptable or good for practical use in case peak voltage V1 is within a range from −525V to −565V, however, bad for practical use in case of −505V or higher.

Fog: acceptable or good for practical use in case peak voltage V1 is −545V or lower, however, bad for practical use in case of −525V or higher.

Highlight section reproducibility: good for practical use in case peak voltage V1 is at any levels within a range of −565V or higher.

Comprehensive evaluation: acceptable for practical use in case peak voltage V1 is −545V, good in case of −565V and bad in case of −525V or higher.

FIG. 17 shows test results obtained on condition Vpp=700V and 45% duty ratio. In the tests of FIG. 17, peak voltage V1 is ranged from −460V to −560V by six levels as shown. In accordance with that, peak voltage V2 is ranged from 240V to 140V in six levels as shown. The table of FIG. 17 indicates the followings.

Image density: acceptable or good for practical use at any levels within the designated range of peak voltage V1.

Evenness of solid section: bad for practical use at any levels within the designated range of peak voltage V1.

Evenness of dot section: bad for practical use at any levels within the designated range of peak voltage V1.

Fog: very bad for practical use at any levels within the designated range of peak voltage V1.

Highlight section reproducibility: good for practical use at any levels within the designated range of peak voltage V1.

Comprehensive evaluation: bad for practical use at any levels within the designated range of peak voltage V1.

FIG. 18 through FIG. 22 show test results obtained on condition that voltages VH and VL are set to −500V and −50V, respectively.

FIG. 18 shows test results obtained on condition Vpp=400V and 40% duty ratio. In the tests of FIG. 18, peak voltage V1 is ranged from −300V to −460V by seven levels as shown. In accordance with that, peak voltage V2 is ranged from 100V to −60V by seven levels as shown. The table of FIG. 18 indicates the followings.

Image density: acceptable or good for practical use in case peak voltage V1 is within a range from −340V to −420V, however, bad for practical use out of the above specified range.

Evenness of solid section: acceptable or very good for practical use in case peak voltage V1 is −400V or higher, particularly very good within a range from −340V to −380V, however, bad for practical use in case of −420V or lower.

Evenness of dot section: acceptable or good for practical use in case peak voltage V1 is −380V or lower, however, bad in case of −360V or higher.

Fog: good for practical use in case peak voltage V1 is −400V or lower, however, bad for practical use in case of −380V or higher.

Highlight section reproducibility: bad for practical use at any levels within the designated range of peak voltage V1.

Comprehensive evaluation: bad for practical use on the whole.

FIG. 19 shows test results obtained on condition Vpp=450V and 25%–50% duty ratio. In the tests of FIG. 19, duty ratio is ranged from 25% to 50% by four levels as shown. Furthermore, under 25%-duty-ratio conditioning, peak voltage V1 is ranged from −325V to −525V by six levels as shown. In accordance with that, peak voltage V2 is ranged from 125V to −75V by six levels as shown. Under 30%-duty-ratio conditioning, peak voltage V1 is ranged from −385V to −485V by six levels as shown. In accordance with that, peak voltage V2 is ranged from 65V to −35V by six levels as shown. Under 40%-duty-ratio conditioning, peak voltage V1 is ranged from −325V to −485V by six levels as shown. In accordance with that, peak voltage V2 is ranged from 125V to −35V by six levels as shown. Under 50%-duty-ratio conditioning, peak voltage V1 is ranged from −325V to −425V in five levels as shown. In accordance with that, peak voltage V2 is ranged from 125V to 25V by five levels as shown.

Test results under 25%-duty-ratio conditioning shown in the table of FIG. 19 indicate the followings.

Image density: acceptable or very good for practical use in case peak voltage V1 is −425V or lower, however, bad for practical use in case of −385V or higher.

Evenness of solid section: acceptable or very good for practical use in case peak voltage V1 is −445V or higher, however, bad for practical use in case of −465V or lower.

Evenness of dot section: acceptable or good for practical use in case peak voltage V1 is −385V or lower, however, bad in case of −325V.

Fog: acceptable or good for practical use in case peak voltage V1 is −445V or lower, however, bad in case of −425V or higher.

Highlight section reproducibility: bad for practical use at any levels of peak voltage V1.

Comprehensive evaluation: bad for practical use on the whole.

Test results under 30%-duty-ratio conditioning shown in the table of FIG. 19 indicate the followings.

Image density: acceptable or very good for practical use in case peak voltage V1 is −405V or lower, however, bad for practical use in case of −385V.

Evenness of solid section: acceptable or very good for practical use in case peak voltage V1 is −445V or higher, especially very good in case of −425V, however, bad for practical use in case of −465V or lower.

Evenness of dot section: acceptable or very good for practical use on the whole and particularly very good in case peak voltage V1 is −425V.

Fog: acceptable or good for practical use in case peak voltage V1 is −445V or lower, however, very bad in case of −425V or higher.

Highlight section reproducibility: bad for practical use at any levels of peak voltage V1.

Comprehensive evaluation: bad for practical use on the whole.

Test results under 40%-duty-ratio conditioning shown in the table of FIG. 19 indicate the followings.

Image density: acceptable or good for practical use in case peak voltage V1 is within a range from −365V to −445V, however, bad for practical use in case of out of the above specified range.

Evenness of solid section: acceptable or very good for practical use in case peak voltage V1 is −445V or higher, particularly very good in case of −425V and −405V, however, bad for practical use in case of −485V.

Evenness of dot section: acceptable or good for practical use in case peak voltage V1 is −365V or lower, however, bad for practical use in case of −325V.

Fog: acceptable or good for practical use in case peak voltage V1 is −445V or lower, however, bad in case of −425V or higher.

Highlight section reproducibility: bad for practical use at any levels of peak voltage V1.

Comprehensive evaluation: bad for practical use on the whole.

Test results under 50%-duty-ratio conditioning shown in the table of FIG. 19 indicate the followings.

Image density: acceptable or good for practical use on the whole.

Evenness of solid section: acceptable or very good for practical use on the whole, and particularly very good in case peak voltage V1 is −405V.

Evenness of dot section: acceptable or very good for practical use in case peak voltage V1 is −385V or lower, particularly very good in case of −425V, however, bad for practical use in case of −365V or higher.

Fog: very bad for practical use at any levels of peak voltage V1.

Highlight section reproducibility: bad for practical use at any levels of peak voltage V1.

Comprehensive evaluation: bad for practical use on the whole.

FIG. 20 shows test results obtained on condition Vpp=600V and 25%–50% duty ratio. In the tests of FIG. 20, duty ratio is ranged from 25% to 50% by four levels as shown. Furthermore, under 25%-duty-ratio conditioning, peak voltage V1 is ranged from −460V to −600V by six levels as shown. In accordance with that, peak voltage V2 is ranged from 140V to 0V by six levels as shown. Under 30%-duty-ratio conditioning, peak voltage V1 is ranged from −460V to −600V by six levels as shown. In accordance with that, peak voltage V2 is ranged from 140V to 0V by six levels as shown. Under40%-duty-ratio conditioning, peak voltage V1 is ranged from −460V to −600V by seven levels as shown. In accordance with that, peak voltage V2 is ranged from 140V to 0V by seven levels as shown. Under 50%-duty-ratio conditioning, peak voltage V1 is ranged from −400V to −480V by five levels as shown. In accordance with that, peak voltage V2 is ranged from 200V to 120V by five levels as shown.

Test results under 25%-duty-ratio conditioning shown in the table of FIG. 20 indicate the followings. It is to be noted since discharge occurred when peak voltage V1 was set to −600V, it is out of evaluation at the level of V1=−600V.

Image density: good for practical use in case peak voltage V1 is −560V, however, bad for practical use in case of −520V or higher.

Evenness of solid section: acceptable or very good for practical use in case peak voltage V1 is −480V or lower, particularly very good in case of −520V, however, bad for practical use in case of −460V.

Evenness of dot section: acceptable or good for practical use in case peak voltage V1 is −480V or lower, however, bad in case of −460V.

Fog: very bad for practical use at any levels of peak voltage V1.

Highlight section reproducibility: good for practical use in case peak voltage V1 is −560V, however, bad for practical use in case of −520V or higher.

Comprehensive evaluation: bad for practical use on the whole.

Test results under 30%-duty-ratio conditioning shown in the table of FIG. 20 indicate the followings. It is to be noted since discharge occurred when peak voltage V1 was set to −600V, it is out of evaluation at the level of V1=−600V.

Image density: acceptable or very good for practical use in case peak voltage V1 is −500V or lower, however, bad for practical use in case of −480V or higher.

Evenness of solid section: acceptable or very good for practical use in case peak voltage V1 is −480V or lower, particularly very good in case of −540V, however, bad for practical use in case of −460V.

Evenness of dot section: acceptable or good for practical use in case peak voltage V1 is −480V or lower, however, bad for practical use in case of −460V.

Fog: very bad for practical use at any levels of peak voltage V1.

Highlight section reproducibility: acceptable or good for practical use in case peak voltage V1 is −540V or lower, however, bad for practical use in case of −500V or higher.

Comprehensive evaluation: bad for practical use on the whole.

Test results under 40%-duty-ratio conditioning shown in the table of FIG. 20 indicate the followings. It is to be noted since discharge occurred when peak voltage V1 was set to −600V, it is out of evaluation at the level of V1=−600V.

Image density: acceptable or good for practical use at any levels within the designated range of peak voltage V1.

Evenness of solid section: acceptable or very good for practical use in case peak voltage V1 is −480V or lower, particularly very good in case of −520V and −540V, however, bad for practical use in case of −460V.

Evenness of dot section: acceptable or very good for practical use in case peak voltage V1 is −480V or lower, particularly very good in case of −500V, however, bad for practical use in case of −460V.

Fog: very bad for practical use at any levels of peak voltage V1.

Highlight section reproducibility: bad for practical use at any levels of peak voltage V1.

Comprehensive evaluation: bad for practical use on the whole.

Test results under 50%-duty-ratio conditioning shown in the table of FIG. 20 indicate the followings.

Image density: acceptable or good for practical use at any levels within the designated range of peak voltage V1.

Evenness of solid section: acceptable for practical use in case peak voltage V1 is −480V, however, bad for practical use in case of −460V or higher.

Evenness of dot section: acceptable for practical use in case peak voltage V1 is −480V, however, bad for practical use in case of −460V or higher.

Fog: very bad for practical use at any levels within the designated range of peak voltage V1.

Highlight section reproducibility: bad for practical use at any levels within the designated range of peak voltage V1.

Comprehensive evaluation: bad for practical use on the whole.

FIG. 21 shows test results obtained on condition Vpp=650V and 40% duty ratio. In the tests of FIG. 21, peak voltage V1 is ranged from −485V to −625V by seven levels as shown. In accordance with that, peak voltage V2 is ranged from 165V to 25V by seven levels as shown. The table of FIG. 21 indicates the followings. It is to be noted since discharge occurred when peak voltage V1 was set to −585V or lower, it is out of evaluation at the level of V1=−585V or lower.

Image density: acceptable or good for practical use in case peak voltage V1 is −565V or higher which is a whole range excluding the out-of-evaluation range, −585V or lower.

Evenness of solid section: acceptable or good for practical use in case peak voltage V1 is within a range from −525V to −565V, however, bad for practical use in case of −505V or higher.

Evenness of dot section: acceptable or good for practical use in case peak voltage V1 is within a range from −525V to −565V, however, bad for practical use in case of −505V or higher.

Fog: very bad for practical use in case peak voltage V1 is −565V or higher.

Highlight section reproducibility: good for practical use in case peak voltage V1 is −565V or higher, acceptable in case of −545V, however, bad for practical use in case of −525V or higher.

Comprehensive evaluation: bad for practical use on the whole.

FIG. 22 shows test results obtained on condition Vpp=700V and 45% duty ratio. In the tests of FIG. 22, peak voltage V1 is ranged from −460V to −560V by six levels as shown. In accordance with that, peak voltage V2 is ranged from 240V to 140V by six levels as shown. The table of FIG. 22 indicates the followings.

Image density: acceptable or good for practical use at any levels within the designated range of peak voltage V1.

Evenness of solid section: bad for practical use at any levels within the designated range of peak voltage V1.

Evenness of dot section: bad for practical use at any levels within the designated range of peak voltage V1.

Fog: very bad for practical use at any levels within the designated range of peak voltage V1.

Highlight section reproducibility: good for practical use at any levels within the designated range of peak voltage V1.

Comprehensive evaluation: bad for practical use at any levels of peak voltage V1.

Test results of FIG. 8 through FIG. 22 lead the following facts.

As to fog, when two conditions, namely, $$VH-V2 \geqq -500\text{V and } V1-VH \geqq -200\text{V},$$

are satisfied, there can be obtained acceptable-for-use results. The followings satisfy the above two conditions: entire range in FIG. 8; portion of 25%-duty-ratio and −465V or higher of voltage V1 in FIG. 9; entire range of 30%-duty-ratio conditioning in FIG. 9; entire range of 40%-duty-ratio conditioning in FIG. 9; entire range of 50%-duty-ratio conditioning in FIG. 9; portion of 25%-duty-ratio and −500V or higher of voltage V1 in FIG. 10; portion of 30%-duty-ratio and −500V or higher of voltage V1 in FIG. 10; portion of 40%-duty-ratio and −500V or higher of voltage V1 in FIG. 10; entire range of 50%-duty-ratio conditioning in FIG. 10; −485V portion of voltage V1 in FIG. 11; −500V portion of voltage V1 in FIG. 12; entire range in FIG. 13; portion of 25%-duty-ratio and −385V or lower of voltage V1 in FIG. 14; entire range of 30%-duty-ratio conditioning in FIG. 14; portion of 40%-duty-ratio and −365V or lower of voltage V1 in FIG. 14; portion of 50%-duty-ratio and −365V or lower of voltage V1 in FIG. 14; portion of 25%-duty-ratio and from −500V to −560V of voltage V1 in FIG. 15; portion of 30%-duty-ratio and from −500V to −560V of voltage V1 in FIG. 15; portion of 40%-duty-ratio and from −500V to −560V of voltage V1 in FIG. 15; −565V portion of voltage V1 in FIG. 16; −400V or lower portions of voltage V1 in FIG. 18; portion of 25%-duty-ratio and −465V or lower of voltage V1 in FIG. 19; portion of 30%-duty-ratio and −465V or lower of voltage V1 in FIG. 19; and portion of 40%-duty-ratio and −485V of voltage V1 in FIG. 19.

The reasons why fog is likely to occur other than the above specified ranges are considered due to following mechanism. That is, like the present embodiment, there is provided a development region for contact developing where developing roller 41 and photo sensitive drum 1 are in contact with each other for development operation, and charges are injected onto toner layer formed on developing roller 41 due to voltage difference of voltages VH and V2. In case "VH−V2" is smaller than −500V, i.e., an absolute value of the subtraction between voltages VH and V2 is larger than 500V, amount of injected charge is large. Thereby, amount of charge to toner decreases or polarity is reversed. The above such toner adheres onto a background section on photosensitive drum 1 and causes fog.

Furthermore, in case "VH−V1" is smaller than −200V, i.e., an absolute value of the subtraction between voltages VH and V1 is larger than 200V, amount of toner adhering onto the background section is considerable. Considerable amount of toner adhesion itself can be a cause of fog. Such adhering toner can be collected if voltage difference of voltages VH and V2 is made larger. However, in such a case, fog due to charge injection, above mentioned, occurs. In case voltage difference of VH and V1 is made small, insufficient collection of toner adhering on the background section is made. Therefore, fog is likely to occur as long as voltage difference of VH and V1 is small.

As to evenness of solid section, when two conditions, namely, $$-150\text{V} \leqq VL-V2 \leqq -70\text{V and } V1-VL \geqq -500\text{V},$$

are satisfied, there can be obtained acceptable-for-use results. The followings satisfy the above two conditions: −380V or higher portion of voltage V1 in FIG. 8; portion of 25%-duty-ratio and from −385V to −425V of voltage V1 in FIG. 9; portion of 30%-duty-ratio and −425V or higher of voltage V1 in FIG. 9; portion of 40%-duty-ratio and from −365V to −425V of voltage V1 in FIG. 9; portion of 50%-duty-ratio and −365V or lower of voltage V1 in FIG. 9; portion of 25%-duty-ratio and from −500V to −520V of voltage V1 in FIG. 10; portion of 30%-duty-ratio and from −500V to −540V of voltage V1 in FIG. 10; portion of 40%-duty-ratio and from −500V to −540V of voltage V1 in FIG. 10; −380V or higher portion of voltage V1 in FIG. 13; portion of 25%-duty-ratio and from −385V to −425V of voltage V1 in FIG. 14; portion of 30%-duty-ratio and −425V or higher of voltage V1 in FIG. 14; portion of 40%-duty-ratio and from −365V to −425V of voltage V1 in FIG. 14; portion of 50%-duty-ratio and −365V or lower of voltage V1 in FIG. 14; portion of 25%-duty-ratio and from −500V to −520V of voltage V1 in FIG. 15; portion of 30%-duty-ratio and from −500V to −540V of voltage V1 in FIG. 15; portion of 40%-duty-ratio and from −500V to −540V of voltage V1 in FIG. 15; −380V or higher portion of voltage V1 in FIG. 18; portion of 25%-duty-ratio and from −385V to −425V of voltage V1 in FIG. 19; portion of 30%-duty-ratio and −425V or higher of voltage V1 in FIG. 19; portion of 40%-duty-ratio and from −365V to −425V of voltage V1 in FIG. 19; portion of 50%-duty-ratio and −365V or lower of voltage V1 in FIG. 19; portion of 25%-duty-ratio and from −500V to −520V of voltage V1 in FIG. 20; portion of 30%-duty-ratio and from −500V to −540V of voltage V1 in FIG. 20; and portion of 40%-duty-ratio and from −500V to −540V of voltage V1 in FIG. 20.

The reasons why evenness of solid section is likely to become worse in case of out-of-the-above-specified ranges are considered due to following mechanism. That is, like the present embodiment, as to contact developing in which developing roller 41 and photosensitive drum 1 are in contact with each other, also, there is a toner-flying region at both upstream and downstream of development region wherein toner oscillates and flies due to development electric field. In case voltage difference of voltages VL and V2 is too small, toner-flying regions are narrow due to weak electric field. Therefore, degree of toner oscillation is insufficient, which causes unevenness of image density. In case voltage difference of VL and V2 is too large, toner-flying regions are enough secured whereas toner once adhered on photosensitive drum 1 comes off excessively. Therefore, unevenness of image density occurs after all. Furthermore, in case voltage difference of voltages VL and V1 is too large, discharge occurs and evenness of solid section is damaged. Therefore, a subtraction of voltages VL and V2 and that of voltages VL and V1 are concluded to be appropriate within respective ranges indicated with expressions in [0074].

As to evenness of dot section, when two conditions, namely, $$V1-VL \leqq -350\text{V and } VL-V2 \geqq -150\text{V},$$

are satisfied, there can be obtained acceptable-for-use results. The followings satisfy the above two conditions: −400V or lower portion of voltage V1 in FIG. 8; portion of 25%-duty-ratio and −425V or lower of voltage V1 in FIG. 9; portion of 30%-duty-ratio and −405V or lower of voltage V1 in FIG. 9; portion of 40%-duty-ratio and −405V or lower of voltage V1 in FIG. 9; portion of 50%-duty-ratio and −405V or lower of voltage V1 in FIG. 9; portion of 25%-duty-ratio and from −500V to −560V of voltage V1 in FIG. 10; portion of 30%-duty-ratio and from −500V to −560V of voltage V1 in FIG. 10; portion of 40%-duty-ratio and from −500V to −560V of voltage V1 in FIG. 10; −565V portion of voltage V1 in FIG. 11; −400V or lower portions of voltage V1 in FIG. 13; portion of 25%-duty-ratio and −445V or lower of voltage V1 in FIG. 14; portion of 30%-duty-ratio and −405V or lower of voltage V1 in FIG. 14; portion of 40%-duty-ratio and −405V or lower of voltage V1 in FIG. 14; portion of 50%-duty-ratio and −405V or lower of voltage V1 in FIG. 14; portion of 25%-duty-ratio and from −500V to −560V of voltage V1 in FIG. 15; portion of 30%-duty-ratio and from −500V to −560V of voltage V1 in FIG. 15; portion of 40%-duty-ratio and from −500V to −560V of voltage V1 in FIG. 15; −565V portion of voltage V1 in FIG. 16; −400V or lower portions of voltage V1 in FIG. 18; portion of 25%-duty-ratio and −425V or lower of voltage V1 in FIG. 19; portion of 30%-duty-ratio and −405V or lower of voltage V1 in FIG. 19; portion of 40%-duty-ratio and −405V or lower of voltage V1 in FIG. 19; portion of 50%-duty-ratio and −405V or lower of voltage V1 in FIG. 19; portion of 25%-duty-ratio and from −500V to −560V of voltage V1 in FIG. 20; portion of 30%-duty-ratio and from −500V to −560V of voltage V1 in FIG. 20; portion of 40%-duty-ratio and from −500V to −560V s of voltage V1 in FIG. 20; and −565V portion of voltage V1 in FIG. 21.

The reasons why evenness of dot section is likely to become worse in case of out-of-the-above-specified ranges are considered due to following mechanism. That is, stronger development electric field is essentially required for appropriate development of a dot section in comparison with a case of solid image development. Therefore, voltage difference of voltages VL and V1 must be 350V or larger. Furthermore, voltage difference of voltages VL and V2 is too large, not only evenness of solid section but also evenness of dot section become worse. This is because toner once adhered on the photosensitive drum 1 comes off excessively. Therefore, a subtraction of voltages VL and V2 and that of voltages VL and V1 are concluded to be appropriate within respective ranges indicted with expression in [0076].

as to highlight section reproducibility, when next condition, namely, $$V1-VH \leqq -50\text{V},$$

is satisfied, there can be obtained acceptable-for-use results. The followings satisfy the above conditions: −360V or lower portion of voltage V1 in FIG. 8; portion of 25%-duty-ratio and −385V or lower of voltage V1 in FIG. 9; portion of 30%-duty-ratio and −405V or lower of voltage V1 in FIG. 9; portion under 40%-duty-ratio and −365V or lower of voltage V1 in FIG. 9; portion of 50%-duty-ratio and −365V or lower of voltage V1 in FIG. 9; portion of 25%-duty-ratio and from −520V to −560V of voltage V1 in FIG. 10; portion of 30%-duty-ratio and from −500V to −560V of voltage V1 in FIG. 10; portion of 40%-duty-ratio conditioning excluding −600V of voltage V1 in FIG. 10; entire range of 50%-duty-ratio conditioning in FIG. 10; any portion other than −585V or lower of voltage V1 in FIG. 11; entire range in FIG. 12; −460V portion of voltage V1 in FIG. 13; portion of 25%-duty-ratio and −465V or lower of voltage V1 in FIG. 14; portion of 30%-duty-ratio and −465V or lower of voltage V1 in FIG. 14; portion of 40%-duty-ratio and −485V of voltage V1 in FIG. 14; portion of 25%-duty-ratio and from −520V to −560V of voltage V1 in FIG. 15; portion of 30%-duty-ratio and from −480V to −560V of voltage V1 in FIG. 15; portion of 40%-duty-ratio conditioning excluding −600V of voltage V1 in FIG. 15; portion of 50%-duty-ratio and −460V or lower of voltage V1 in FIG. 15; any portion excluding −585V or lower of voltage V1 in FIG. 16; entire region in FIG. 17; portion of 25%-duty-ratio and −560V of voltage V1 in FIG. 20; portion of 30%-duty-ratio and −560V of voltage V1 in FIG. 20; and −565V portion of voltage V1 in FIG. 21.

For preferable reproduce of a highlight section in an image, toner adhesion is required even for a background section once. Therefore, at least, a condition V1<VH must be satisfied and preferable results are obtained constantly within the range of the expression in [0078].

Comprehensively concluding on preferable voltage setting for combination of one-component contact developing and application of AC bias, when all of the following four expressions are satisfied, preferable results on fog condition, evenness degree of solid section/dot section, and highlight section reproducibility are obtained while appropriate image density is secured.

$$-500\text{V} \leqq V1-VL \leqq -350\text{V}$$

$$-150\text{V} \leqq VL-V2 \leqq -70\text{V}$$

$$V2-500\text{V} \leqq VH \leqq V1+200\text{V}$$

$$-200\text{V} \leqq V1-VH \leqq -50\text{V}$$

Thereby, conditions voltages V1 and V2 should satisfy are defined as follows.

Voltage V1 should satisfy following two conditions.

$$-500V \leqq V1 - VL \leqq -350V$$

$$-200V \leqq V1 - VH \leqq -50V$$

Voltage V2 should satisfy following two conditions.

$$-150V \leqq VL - V2 \leqq -70V$$

$$V2 \leqq VH + 500V$$

Next, there will be described tests of variously changing frequency of alternating current voltage VAC. The tests were conducted within thus specified voltage conditions wherein voltages VH and VL are set to −350V and −50V, respectively. In the tests, evaluations are made with respect to quality of granulation degree, gradation, and fog. As to fog, evaluations are made in a manner similar to the foregoing. As to granulation degree and gradation, a gradation pattern of thirty-two levels is outputted and evaluations are made based on the outputted gradation pattern, as follows.

Granulation degree: A value of a gradation pattern read out by a CCD was firstly obtained and then, Fourier transformation, under consideration of MTF (Modulation Transfer Function) correction, is applied to the readout value. Thus obtained image is evaluated in accordance with GI (Graininess Index) evaluation met with human's relative visibility. In detail, a maximum value of GI value obtained at a highlight section (L*Value>60) in an image was an object of granulation-degree evaluation. As a GI value goes down to smaller one, it is evaluated highly. Evaluation is set as shown in the table of FIG. 23. GI value mentioned herein is what is recited in Journal of the Imaging Society of Japan 39(2), 84•93(2000).

Gradation: Reflection density (ID) of a gradation pattern is measured with the Macbeth densitometer, and the number of gradations (larger number is more preferable), in which a range from 10% to 90% of density to highest density (TD) is obtainable, is counted and ranking evaluation is set as shown in the table of FIG. 24.

FIG. 25 shows evaluation results. The tests were made with two bias conditions, namely, (V1=−500V, V2=+100V), (V1=−425V, V2=+25V) and with six levels of frequency within a range from 1 kHz to 7 kHz. Duty ratio for the respective levels were set such that highest density (TD) fits in an appropriate value (1.32≦TD≦1.42). The table of FIG. 25 indicates the followings.

Granulation degree: Acceptable for practical use in case frequency is 1.5 kHz or higher and particularly good in case within a range from 2 kHz to 5 kHz.

In case frequency level is too low, respective durations T1 and T2 (see FIG. 2) for voltages V1 and V2 are long. Subsequently, toner does not oscillate sufficiently at toner-flying regions (regions adjoining to upstream and downstream of a development region) and granulation degree lowers. On the other hand, in case frequency level is too high, respective durations T1 and T2 are short. Subsequently, toner flying away from developing roller 41 is hard to reach photosensitive drum 1. This means substantial toner-flying region is narrow. As a result, it is considered that toner does not oscillate sufficiently and granulation degree lowers. Therefore, an appropriate frequency range good for granulation degree is 1.5 kHz at minimum (more preferably, 2 kHz) and 7 kHz at maximum (more preferably, 5 kHz).

Gradation: Acceptable for practical use in case of 1.5 kHz or higher and particularly good in case of 2 kHz or higher. In case frequency level is too low, it is considered that toner does not oscillate sufficiently due to the mechanism as described in granulation degree. As a result, gradation lowers.

Fog: acceptable for practical use in case of 1.5 kHz or higher and particularly good in case of 2 kHz or higher.

In case frequency level is too low, it is considered that toner does not oscillate sufficiently due to the mechanism as described in granulation degree and gradation. As a result, fog deteriorates.

Judging from the above results, a frequency range from 1.5 kHz to 7 kHz (more preferably, from 2 kHz to 5 kHz ) is favorable frequency setting to secure appropriate image density and obtain preferable results with respect to granulation degree, gradation and fog in case one-component contact developing and use of alternating current bias are applied.

Generally, an image forming apparatus has mechanism to control image density depending on environmental conditions, i.e., temperature and humidity. That is, charge degree of toner varies due to environmental condition and image density receives influence of it. More specifically, since charge degree of toner is high when humidity is low, degree of development tends to be low. Such a problem can be resolved by increasing duty ratio or making an absolute value of voltage difference of voltages V1 and VL large. On the other hand, since charge degree of toner is low when humidity is high, degree of development tends to be high. Such a problem can be resolved by decreasing duty ratio or making an absolute value of voltage difference of voltages V1 and VL small.

The laser-beam printer of the present embodiment also has environment sensor 9 for that purpose. By changing duty ratio, voltage V1, and voltage V2 depending on temperature and humidity, appropriate image density can be obtained. There were conducted tests for verifying appropriate image formation can be done under high temperature and high humidity environment and low temperature and low humidity environment within the ranges of the above-mentioned voltage and frequency conditions. FIG. 26 shows the test results. In the tests, image formation was done under three conditions, namely, medium temperature and medium humidity (23° C. 60% RH) as normal state, low temperature and low humidity (10° C. 15% RH), and high temperature and high humidity (30° C. 85% RH), wherein voltages VH and VL are set to −350V and −50V, respectively. Evaluation items are image density, evenness of solid section, evenness of dot section, fog, and highlight section reproducibility, similar to the tests directed to FIG. 8 through FIG. 22.

Under medium temperature and medium humidity condition, voltages V1, V2, and duty ratio were set to −450V, +50V, and 40%, respectively, and preferable results were obtained with respect to all of the evaluation items. Under low temperature and low humidity condition, tests were conducted in two ways of bias setting: voltage V1=−550V, voltage V2=+50V, and duty ratio=40% (an absolute value of "V1−VL" is made larger than the case of medium temperature and medium humidity conditioning); and voltage V1=−450V, voltage V2=+50V, and duty ratio=50% (duty ratio is made larger than the case of medium temperature and medium humidity). With either bias setting, preferable results were obtained with respect to all of the evaluation items. Under high temperature and high humidity condition, tests are conducted in two ways of bias setting: voltage V1=−400V, voltage V2=+100V, duty ratio 40% (an absolute value of "V1−VL" is made smaller and that of "VL−V2" is made larger than the case of medium temperature and medium humidity conditioning); and voltage V1=−450V, voltage V2=+50V, and duty ratio=30% (duty ratio is made smaller than the case of medium temperature and medium humidity conditioning) With either bias setting, preferable results are obtained with respect to all of the evaluation items.

From the above test results, humidity-related setting can be concluded as follows. That is, it is preferable that duty ratio of voltage oscillation be set low in case of high humidity and set high in case of low humidity. It is preferable that voltage difference of voltages V1 and VL be set low in case of high humidity and set high in case of low humidity. Furthermore, it is preferable that voltage difference of voltages V2 and V1 be set high in case of high humidity and set low in case of low humidity.

Figure 27:
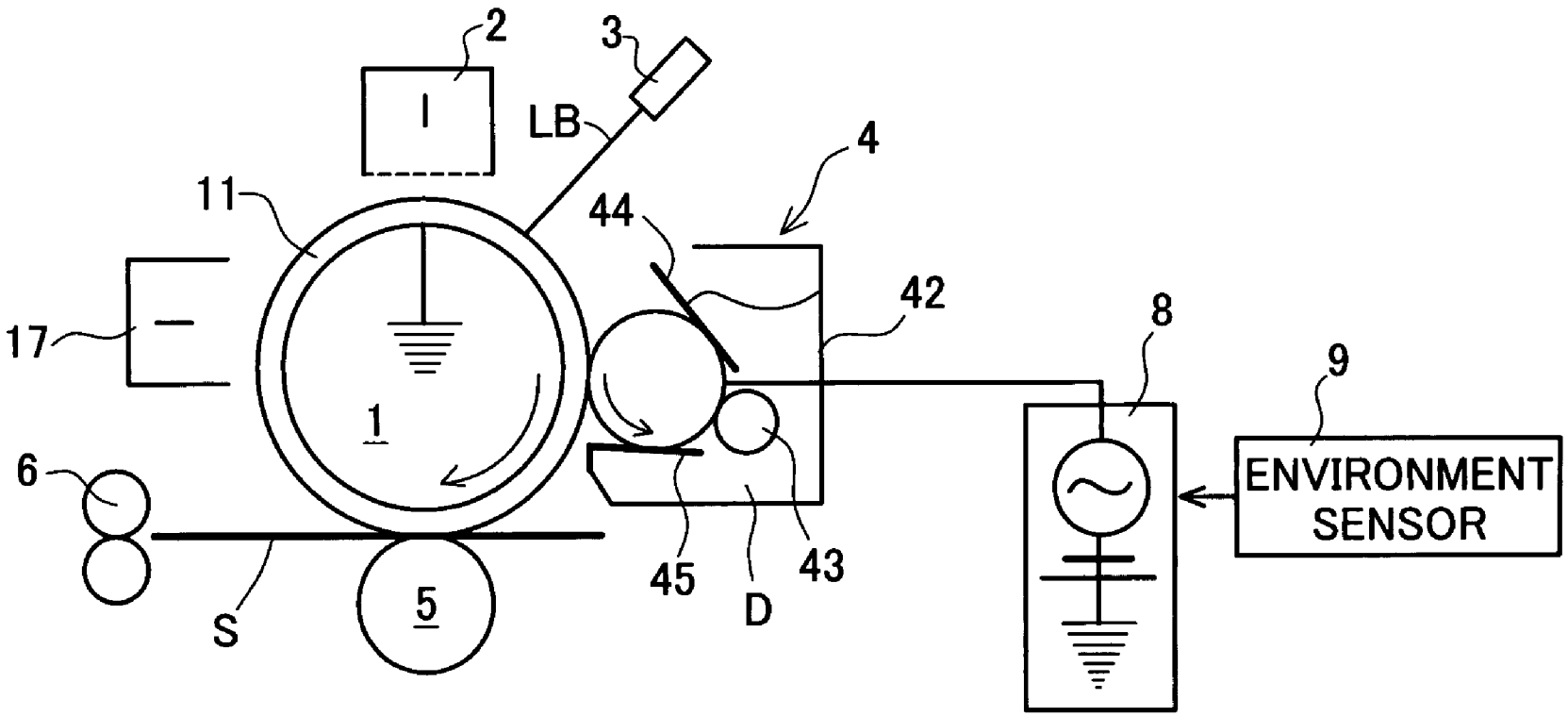
FIG. 27 is a structure diagram showing main part of a laser-beam printer directed to another embodiment.

Next, there will be described that the present invention is applicable to an image forming apparatus structured not same as the image forming apparatus shown in FIG. 1. FIG. 27 shows a main portion of a laser-beam printer employing cleaner-less system. The essential structure of the laser-beam printer shown in FIG. 27 is common to the laser-beam printer shown in FIG. 1. The only difference is that a cleaner 7 is eliminated and instead of it, a charging adjustment member 17 is arranged. Voltage of which polarity is same as polarity of charged toner is applied to the charging adjustment member 17. Thereby, the charging adjustment member 17 has a function to correct polarity of toner remaining after image transfer and to charge it. Toner polarity of which is corrected passes through the charger 2 and reaches the development region along with rotation of the photosensitive drum 1. Since development bias satisfying the above described conditions is applied to the development region, toner remaining after image transfer is collected with the developing apparatus 4 by voltage difference of voltages VH and V2. Thus, a cleaner 7 is not indispensable for image forming apparatuses.

In case of an image forming apparatus adopting cleaner-less system, AC bias system is apparently more advantageous than DC bias system. That is, toner remaining after image transfer can surely be collected to the developing apparatus 4. Since alternating current component is superimposed on development bias, collection electric field of remaining toner can be taken large instantly. Even such structured image forming apparatus can make preferable image formation by applying the above mentioned bias setting.

In the descriptions of the embodiment so far, it is regarded that a photosensitive drum 1 of negatively-charged-type and toner of negative-polarity are used. However, the present invention is not restricted to the above such polarity combination but applicable to a combination of a photosensitive drum of positively-charged-type and toner of positive-polarity. In that case, expressions of voltage setting for good results on fog, evenness of solid section/dot section, and highlight section reproducibility while securing appropriate image density are as follows. Such expressions are obtained due to difference of "+" and "−".

$$350\text{V} \leqq V1 - VL \leqq 500\text{V}$$

$$70\text{V} \leqq VL - V2 < 150\text{V}$$

$$V1 - 200\text{V} \leqq VH \leqq V2 + 500\text{V}$$

$$50\text{V} \leqq V1 - VH \leqq 200\text{V}$$

Therefore, in case a photosensitive drum of positively-charged-type and toner of positive-polarity are used, voltages V1 and V2 must satisfy following expressions.

Voltage V1 must satisfy following two expressions.

$$350\text{V} \leqq V1 - VL \leqq 500\text{V}$$

$$50\text{V} \leqq V1 - VH \leqq 200\text{V}$$

Voltage V2 must satisfy following two expressions.

$$70\text{V} \leqq VL - V2 \leqq 150\text{V}$$

$$VH - 500\text{V} \leqq V2$$

As described, according to the present embodiment, there are realized a developing apparatus 4, developing method, and a laser-beam printer employing the developing apparatus 4 capable of conducting high-quality image formation by adopting both contact developing and AC developing and setting various bias conditions appropriately. Accordingly, the present invention does not require strict interval control of development regions like non-contact developing. Therefore, control system of the present invention has fewer burdens in comparison with non-contact developing. While the less burden to control system, the present invention can obtain high-quality images by effectively using edge effect caused by oscillation of flying toner at regions adjoining to upstream and downstream of a development region. Furthermore, despite AC developing, Vpp is set to 650V at highest and Vpp can go with 600V or lower in many cases. Therefore, load to power supply system is not considerably large. Furthermore, appropriate image formation is realized by changing bias conditions depending on environmental conditions.

The above described embodiments are provided for mere illustrative purpose, and the present invention is not limited thereto. Of course, various modifications or variations can occur without departing the spirit of the invention. For example, although the embodiment describes a laser-beam printer as an example of the present invention, the present invention is applicable to a copier, a facsimile, a multi function processing machine. Furthermore, it is also applicable to a multi-color apparatus. A photosensitive body is not restricted to drum or roller type but belt type may be applicable. A charger may be equipped with any types of charging member such as brush-type, corotron-type, roller-type, sheet-type, blade-type, and the like. An exposure is not restricted to laser beam but LED-type and analog optical system may be applicable.

Furthermore, alternating current voltage VAC is not restricted to rectangular-waveform type but may be sine-waveform type, triangular-waveform type, sawtooth-waveform type, and the like. In case of non-rectangular-waveform types, voltages V1 and V2 may be defined as respective peak voltages of in waveform. Durations T1 and T2 may be defined high-voltage-side time and low-voltage-side time, respectively, looked from direct current voltage VDC as a boarder. Duty ratio may be defined basing on thus defined durations T1 and T2.

What is claimed is:

1. A developing apparatus comprising:

a development member for developing an electrostatic latent image on an image carrier by applying one-component non-magnetic toner, the development member being in contact with the image carrier;

a regulating member for regulating thickness of toner layer on the development member; and a voltage applier for applying bias voltage to a portion between the development member and the image carrier, the bias voltage oscillating between voltages V1 and V2, wherein voltage V1 satisfies all of conditions (1) through (3), and voltages V1 and VH exhibit homopolarity with reference to voltage Vg, $$|VH - Vg| < |V1 - Vg| \quad (1)$$

$$350\ V \leqq |V1 - VL| \leqq 500\ V \quad (2)$$

$$\left.\begin{array}{l} VH - 200\ V \leqq V1\ (\text{in case } VH < 0) \\ V1 \leqq VH + 200\ V\ (\text{in case } VH > 0) \end{array}\right\} \quad (3)$$

voltage V2 satisfies both conditions (4) and (5), and voltages V2 and V1 exhibit antipolarity with reference to voltage VL, $$70\ V \leqq |V2 - VL| \leqq 150\ V \quad (4)$$

$$\left.\begin{array}{l} V2 \leqq VH + 500\ V\ (\text{in case } VH < 0) \\ VH - 500\ V \leqq V2\ (\text{in case } VH > 0) \end{array}\right\} \quad (5)$$

and above notations represent

Vg: ground voltage,

VH: voltage of a background section in an electrostatic latent image formed on the image carrier, and VL: voltage of a visible section in an electrostatic latent image formed on the image carrier, VL and VH exhibit homopolarity with reference to Vg, and a condition |VL−Vg|<|VH−Vg| is satisfied.

2. A developing apparatus according to claim 1, wherein voltage V1 further satisfies a condition (6), $$50\text{V} \leqq |V1 - VL| \leqq 200\text{V} \quad (6).$$

3. A developing apparatus according to claim 1, wherein frequency of bias voltage applied by the voltage applier is within a range from 1.5 kHz to 7 kHz.

4. A developing apparatus according to claim 1, wherein duty ratio of bias voltage amplitude is set low in case of high humidity and set high in case of low humidity.

5. A developing apparatus according to claim 1, wherein difference of voltages V1 and VL is set low in case of high humidity and set high in case of low humidity.

6. A developing apparatus according to claim 1, wherein difference of voltages V2 and VL is set high in case of high humidity and set low in case of low humidity.

7. An image forming apparatus comprising:

an image carrier;

a charger for getting a surface of the image carrier charged;

an exposer for exposing charged surface of the image carrier and forming an electrostatic latent image; and a developing apparatus comprising:

a development member for developing an electrostatic latent image on the image carrier by applying one-component non-magnetic toner, the development member being in contact with the image carrier;

a regulating member for regulating thickness of toner layer on the development member; and a voltage applier for applying bias voltage to a portion between the development member and the image carrier, the bias voltage oscillating between voltages V1 and V2, wherein voltage V1 satisfies all of conditions (1) through (3), and voltages V1 and VH exhibit homopolarity with reference to voltage Vg, $$|VH - Vg| < |V1 - Vg| \quad (1)$$

$$350\ V \leqq |V1 - VL| \leqq 500\ V \quad (2)$$

$$\left.\begin{array}{l} VH - 200\ V \leqq V1\ (\text{in case } VH < 0) \\ V1 \leqq VH + 200\ V\ (\text{in case } VH > 0) \end{array}\right\} \quad (3)$$

voltage V2 satisfies both conditions (4) and (5), and voltages V2 and V1 exhibit antipolarity with reference to voltage VL, $$70\ V \leqq |V2 - VL| \leqq 150\ V \quad (4)$$

$$\left.\begin{array}{l} V2 \leqq VH + 500\ V\ (\text{in case } VH < 0) \\ VH - 500\ V \leqq V2\ (\text{in case } VH > 0) \end{array}\right\} \quad (5)$$

and above notations represent

Vg: ground voltage,

VH: voltage of a background section in an electrostatic latent image formed on the image carrier, and VL: voltage of a visible section in an electrostatic latent image formed on the image carrier, VL and VH exhibit homopolarity with reference to Vg, and a condition |VL−Vg|<|VH−Vg| is satisfied.

8. An image forming apparatus according to claim 7, wherein voltage V1 further satisfies a condition (6), $$50\text{V} \leqq |V1 - VL| \leqq 200\text{V} \quad (6).$$

9. An image forming apparatus according to claim 7, wherein frequency of bias voltage applied by the voltage applier is within a range between 1.5 kHz and 7 kHz.

10. An image forming apparatus according to claim 7 further comprising an environment sensor for detecting humidity, wherein the voltage applier changes waveform of bias voltage depending on an output from the environment sensor.

11. An image forming apparatus according to claim 10, wherein duty ratio of bias voltage amplitude is set low in case of high humidity and set high in case of low humidity.

12. An image forming apparatus according to claim 10, wherein difference of voltages V1 and VL is set low in case of high humidity and set high in case of low humidity.

13. An image forming apparatus according to claim 10, wherein difference of voltages V2 and VL is set high in case of high humidity and set low in case of low humidity.

14. Developing method for an electrophotograph-type image forming apparatus, comprising:

process of forming one-component non-magnetic toner layer on a development member; and process of developing an electrostatic latent image by applying bias voltage to a portion between the development member and an image carrier, the bias voltage oscillating between voltages V1 and V2, the development member being in contact with the image carrier on which an electrostatic latent image is formed, wherein voltage V1 satisfies all of conditions (1) through (3), and voltages V1 and VH exhibit homopolarity with reference to voltage Vg, $$|VH - Vg| < |V1 - Vg| \quad (1)$$

$$350\ V \leqq |V1 - VL| \leqq 500\ V \quad (2)$$

$$\left.\begin{array}{l} VH - 200\ V \leqq V1\ (\text{in case } VH < 0) \\ V1 \leqq VH + 200\ V\ (\text{in case } VH > 0) \end{array}\right\} \quad (3)$$

voltage V2 satisfies both conditions (4) and (5), and voltages V2 and V1 exhibit antipolarity with reference to voltage VL, $$70\ V \leqq |V2 - VL| \leqq 150\ V \quad (4)$$

$$\left.\begin{array}{l} V2 \leqq VH + 500\ V\ (\text{in case } VH < 0) \\ VH - 500\ V \leqq V2\ (\text{in case } VH > 0) \end{array}\right\} \quad (5)$$

and above notations represent

Vg: ground voltage,

VH: voltage of a background section in an electrostatic latent image formed on the image carrier, and VL: voltage of a visible section in an electrostatic latent image formed on the image carrier, VL and VH exhibit homopolarity with reference to Vg, and a condition $|VL-Vg|<|VH-Vg|$ is satisfied.

15. Developing method according to claim 14, wherein voltage V1 further satisfies a condition (6), $$50V \leqq |V1 - VL| \leqq 200V \quad (6).$$

16. Developing method according to claim 14, wherein frequency of bias voltage is within a range from 1.5 kHz to 7 kHz.

17. Developing method according to claim 14 further comprising process of detecting humidity, and process of adjusting waveform of bias voltage depending on detected humidity.

18. Developing method according to claim 17, wherein duty ratio of bias voltage amplitude is set low in case of high humidity and set high in case of low humidity.

19. Developing method according to claim 17, wherein difference of voltages V1 and VL is set low in case of high humidity and set high in case of low humidity.

20. Developing method according to claim 17, wherein difference of voltages V2 and VL is set high in case of high humidity and set low in case of low humidity.

* * * * *